US011279145B2

(12) United States Patent
Nakatani

(10) Patent No.: US 11,279,145 B2
(45) Date of Patent: Mar. 22, 2022

(54) THERMAL PRINT HEAD AND METHOD OF MANUFACTURING THE SAME

(71) Applicant: Rohm Co., Ltd., Kyoto (JP)

(72) Inventor: Goro Nakatani, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 29 days.

(21) Appl. No.: 16/908,143

(22) Filed: Jun. 22, 2020

(65) Prior Publication Data

US 2020/0406631 A1 Dec. 31, 2020

(30) Foreign Application Priority Data

Jun. 25, 2019 (JP) ..... JP2019-117056

(51) Int. Cl.
*B41J 2/335* (2006.01)
*B41J 2/34* (2006.01)

(52) U.S. Cl.
CPC ..... *B41J 2/34* (2013.01); *B41J 2/3355* (2013.01); *B41J 2/3359* (2013.01); *B41J 2/33505* (2013.01)

(58) Field of Classification Search
CPC ..... B41J 2/34; B41J 2/33505; B41J 2/3355; B41J 2/3359
See application file for complete search history.

(56) References Cited

U.S. PATENT DOCUMENTS

| | | | | |
|---|---|---|---|---|
| 4,742,362 | A | 5/1988 | Takoshima et al. | |
| 2002/0158959 | A1 | 10/2002 | Shirakawa et al. | |
| 2003/0103112 | A1* | 6/2003 | Shirakawa | B41J 2/3353 347/64 |
| 2017/0182794 | A1* | 6/2017 | Nishimura | B41J 2/3351 |

FOREIGN PATENT DOCUMENTS

| | | | | |
|---|---|---|---|---|
| JP | 2007-269036 | A | 10/2007 | |
| JP | 2019-14233 | S | 1/2019 | |
| JP | 2019014233 | A * | 1/2019 | B41J 2/33515 |

OTHER PUBLICATIONS

Form PTO-892 issued in co-pending U.S. Appl. No. 16/911,293 (1 page).
Form PTO-892 issued in co-pending U.S. Appl. No. 16/911,293, filed Jul. 8, 2021 (1 page).

* cited by examiner

*Primary Examiner* — Yaovi M Ameh
(74) *Attorney, Agent, or Firm* — Hamre, Schumann, Mueller & Larson, P.C.

(57) ABSTRACT

A thermal print head includes a substrate; a protrusion formed on an obverse surface of the substrate and extending in a main scanning direction; heat generating parts disposed on a top surface of the protrusion and arranged along the main scanning direction; and columnar heat storage members embedded in the protrusion and disposed in a given area having a width in a sub-scanning direction and being elongated in the main scanning direction. Each of the columnar heat storage members is elongated in a thickness direction of the substrate and has an upper end and a lower end, with the upper end being disposed at the same level of the top surface of the protrusion.

16 Claims, 28 Drawing Sheets

A1

A1

THERMAL PRINT HEAD AND METHOD OF MANUFACTURING THE SAME

FIELD

The present disclosure relates to a thermal print head and a method of manufacturing the same.

BACKGROUND

JP-A-2007-269036 discloses an example of a conventional thermal print head. The thermal print head includes numerous heat generating parts aligned in a main scanning direction on a head substrate. The heat generating parts are provided by exposed parts of a resistor layer formed on a head substrate via a glaze layer, with an upstream electrode layer and a downstream electrode layer both overlapping with the resistor layer in a manner such that their ends are spaced apart so as to expose the above-mentioned parts of the resistor layer. By energizing through the upstream electrode layer and the downstream electrode layer, the exposed parts (heat generating parts) of the resistor layer are selectively heated by Joule's effect.

The thermal print head disclosed in the above-cited document also includes a protruded glaze that extends in the main scanning direction and serves as a heat storage, with the heat generating parts disposed on the top of the protruded glaze for effective heat transfer to a printing medium and for high-speed printing, for example. Such a protruded glaze allows the heat generating parts to come into proper contact with a platen roller, thereby improving the printing quality.

In general, the protruded glaze as described above is formed by performing screen printing with glass paste and baking the glass paste. However, in the method for forming the protruded glaze as described above, the thickness of a film formed during a printing process may vary for each product or in various places in the main scanning direction. These factors hinder maintaining the product quality or printing quality of the thermal print head at a constant level.

JP-A-2019-14233 also discloses a technique related to a thermal print head. According to the technique, anisotropic etching is performed on a single-crystal semiconductor so that a protrusion for heat generating parts is formed on the resulting head substrate. In this case, the protrusion can be formed to have a uniform shape along the main scanning direction. However, since a single-crystal semiconductor has better heat conductivity than glass, it is necessary to provide adequate heat storage property without compromising the desired shape of the protrusion.

SUMMARY

In view of the above circumstances, the present disclosure aims to provide a thermal print head capable of providing adequate heat storage property for a protrusion which is formed on a head substrate to dispose heat generating parts.

According to a first aspect of the present disclosure, there is provided a thermal print head including: a substrate having an obverse surface; a protrusion formed on the obverse surface of the substrate and extending in a main scanning direction; heat generating parts disposed on a top surface of the protrusion and arranged along the main scanning direction; and columnar heat storage members embedded in the protrusion and disposed in a given area having a width in a sub-scanning direction and being elongated in the main scanning direction. Each of the columnar heat storage members is elongated in a thickness direction of the substrate and has an upper end and a lower end, where the upper end is disposed at a same level of the top surface of the protrusion.

According to a second aspect of the present disclosure, there is provided a method for manufacturing a thermal print head comprising: a substrate having an obverse surface; a protrusion formed on the obverse surface of the substrate and extending in a main scanning direction; heat generating parts disposed on a top surface of the protrusion and arranged along the main scanning direction; and columnar heat storage members embedded in the protrusion and disposed in a given area having a width in a sub-scanning direction and being elongated in the main scanning direction, each of the columnar heat storage members being elongated in a thickness direction of the substrate and having an upper end and a lower end, the upper end being disposed at a same level of the top surface of the protrusion, the top surface including a pair of first inclined outer surfaces that are connected to respective sides of the top surface in the sub-scanning direction and inclined relative to the obverse surface so as to be lower with increasing distance from the top surface in the sub-scanning direction. The method includes: forming the columnar heat storage members in an area of an obverse surface of a material substrate made of a single-crystal semiconductor, where the area corresponds to the top surface of the protrusion; and performing anisotropic etching with respect to the obverse surface of the material substrate so that the protrusion is formed to have the top surface and the pair of inclined outer surfaces.

According to a third aspect of the present disclosure, there is provided a method for manufacturing a thermal print head including: a substrate having an obverse surface; a protrusion formed on the obverse surface of the substrate and extending in a main scanning direction; heat generating parts disposed on a top surface of the protrusion and arranged along the main scanning direction; and columnar heat storage members embedded in the protrusion and disposed in a given area having a width in a sub-scanning direction and being elongated in the main scanning direction, each of the columnar heat storage members being elongated in a thickness direction of the substrate and has an upper end and a lower end, the upper end being disposed at a same level of the top surface of the protrusion, the protrusion including a pair of first inclined outer surfaces and a pair of second inclined outer surfaces, the pair of second inclined outer surfaces being connected to respective sides of the top surface in the sub-scanning direction and inclined relative to the obverse surface so as to be lower with increasing distance from the top surface in the sub-scanning direction, the pair of first inclined outer surfaces being connected to sides of the pair of second inclined outer surfaces opposite from sides thereof that are connected to the top surface in the sub-scanning direction, the pair of first inclined outer surfaces being inclined relative to the obverse surface with increasing distance from the top surface in the sub-scanning direction with an inclination angle relative to the obverse surface being greater than an inclination angle of the pair of second inclined outer surfaces relative to the obverse surface. The method includes: forming the columnar heat storage members in an area of an obverse surface of a material substrate made of a single-crystal semiconductor, where the area corresponds to the top surface of the protrusion; and performing anisotropic etching with respect to the obverse surface of the material substrate so that the protrusion is formed to have the pair of first inclined outer surfaces, the pair of second inclined outer surfaces and the top surface.

According to a fourth aspect of the present disclosure, there is provided a method for manufacturing a thermal print head, where the method includes: forming a heat storage; and forming a plurality of heat generating parts on the heat storage. The forming of the heat storage includes: performing deep etching with respect to an obverse surface of a Si wafer as a material substrate so that micropores each extending in a thickness direction of the material substrate are formed in the material substrate; and performing a thermal oxidation treatment with respect to the micropores to produce $SiO_2$.

Further features and advantages of the present disclosure will become apparent from the following detailed description with reference to the attached drawings.

DRAWINGS

EMBODIMENTS

Figure 1:
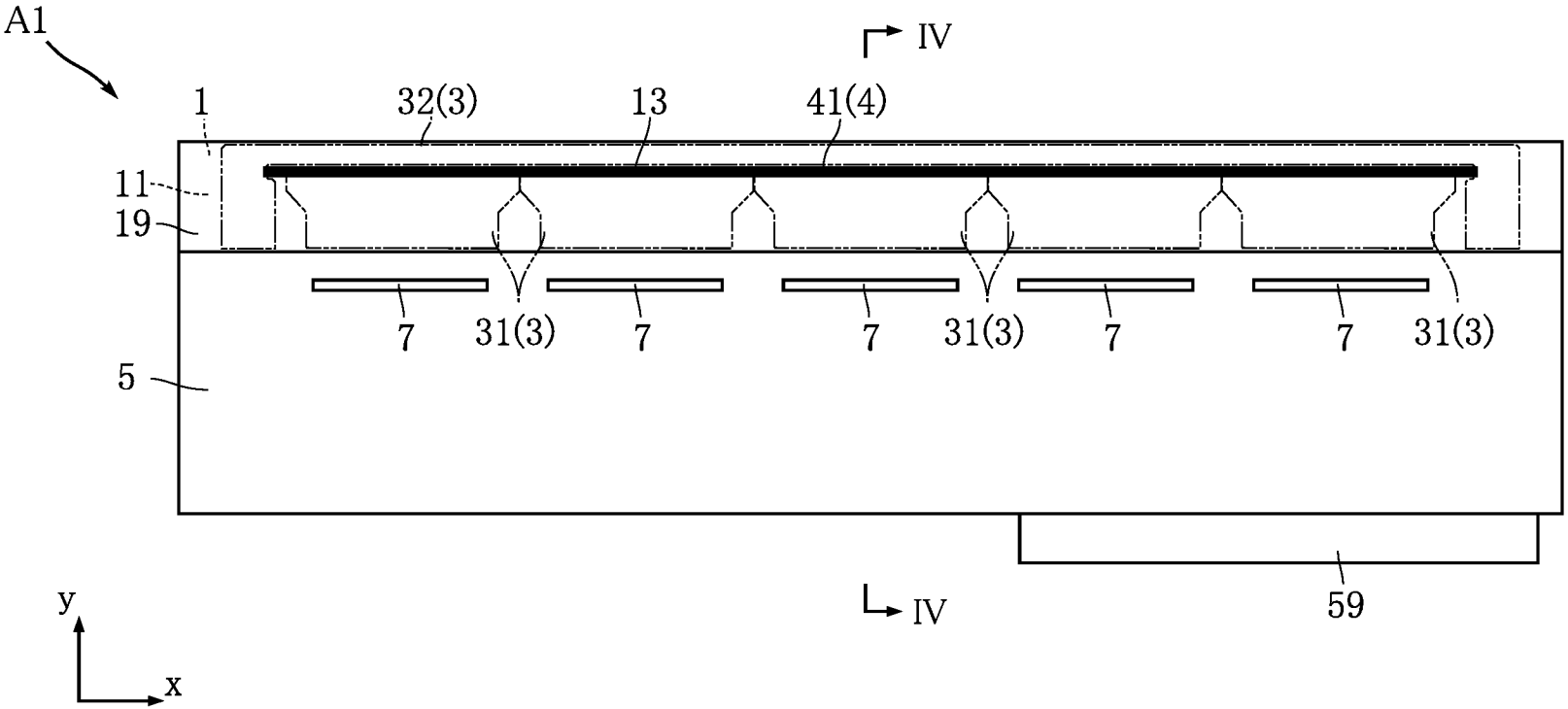
FIG. 1 is a plan view showing a thermal print head according to a first embodiment of the present disclosure.
Figure 2:
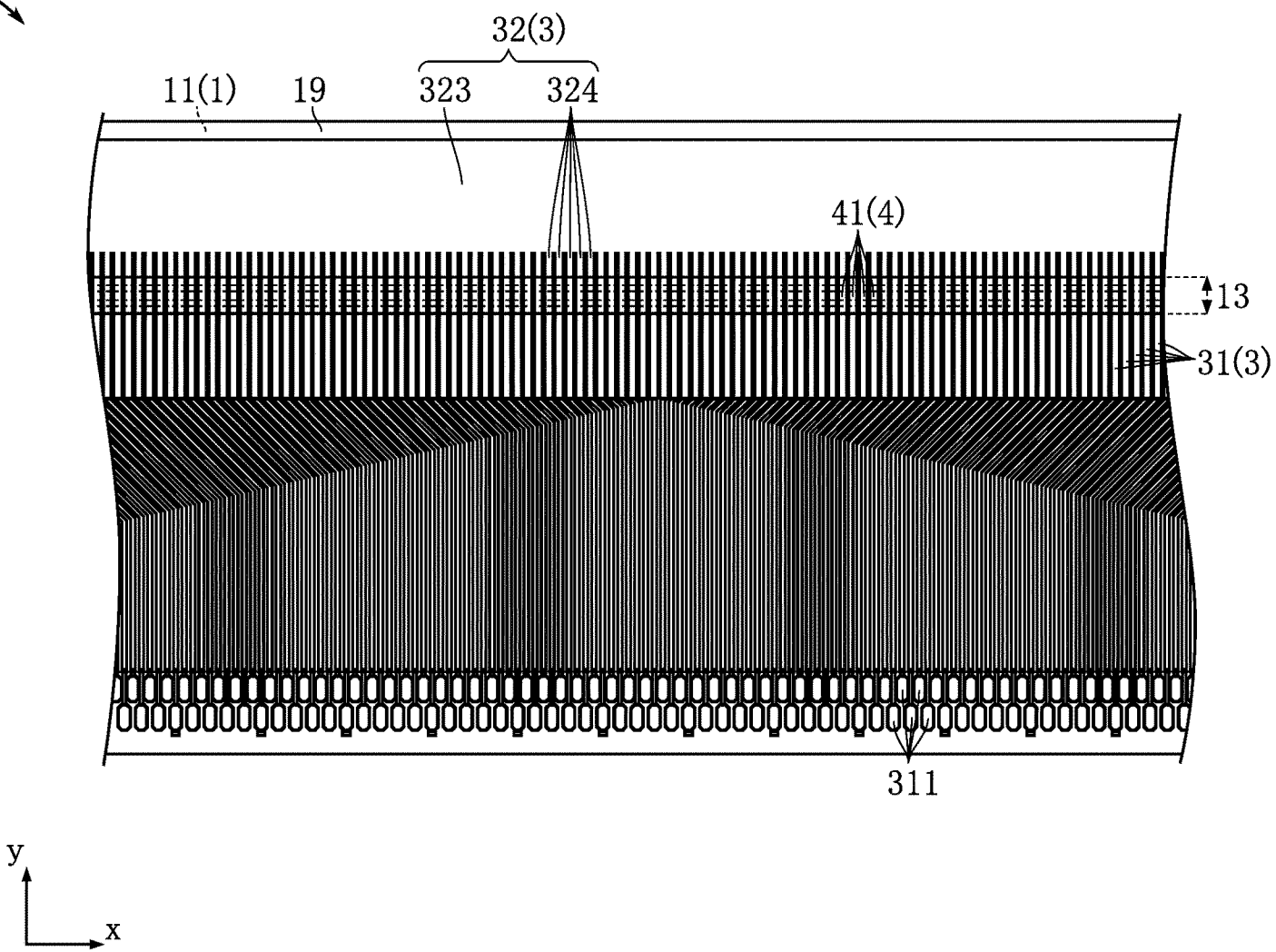
FIG. 2 is a main-part plan view showing the thermal print head according to the first embodiment.
Figure 3:
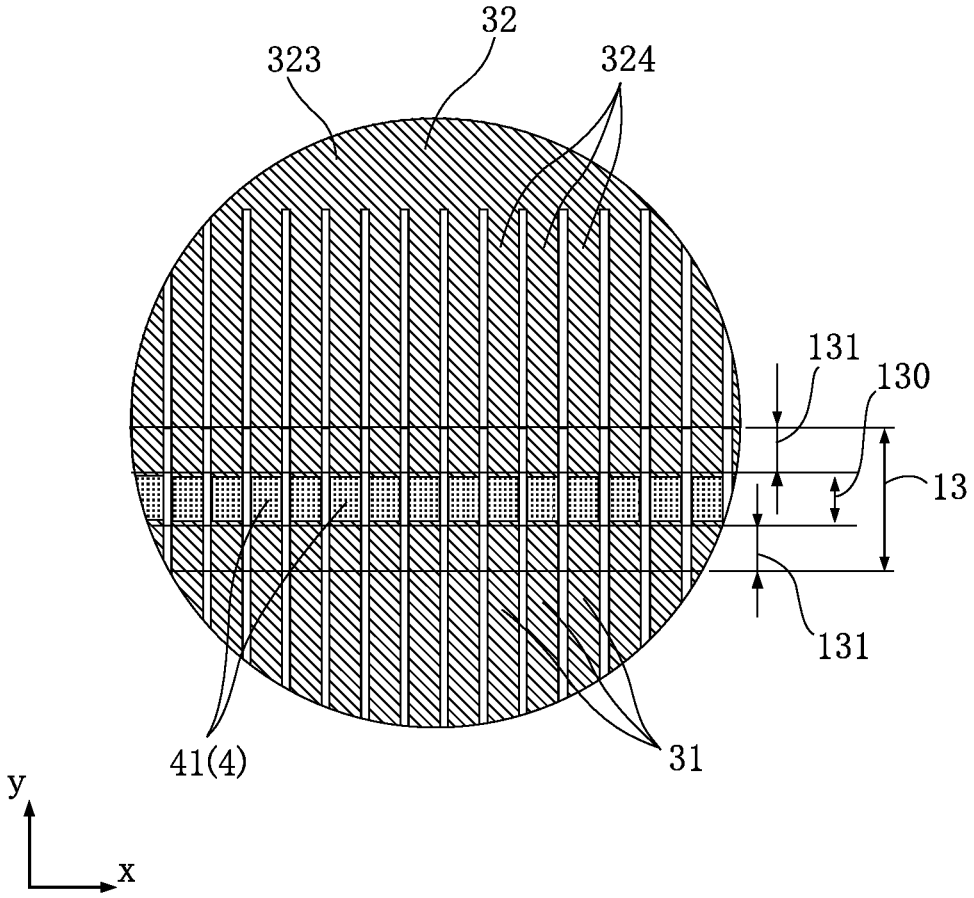
FIG. 3 is a main-part enlarged plan view showing the thermal print head according to the first embodiment.
Figure 4:
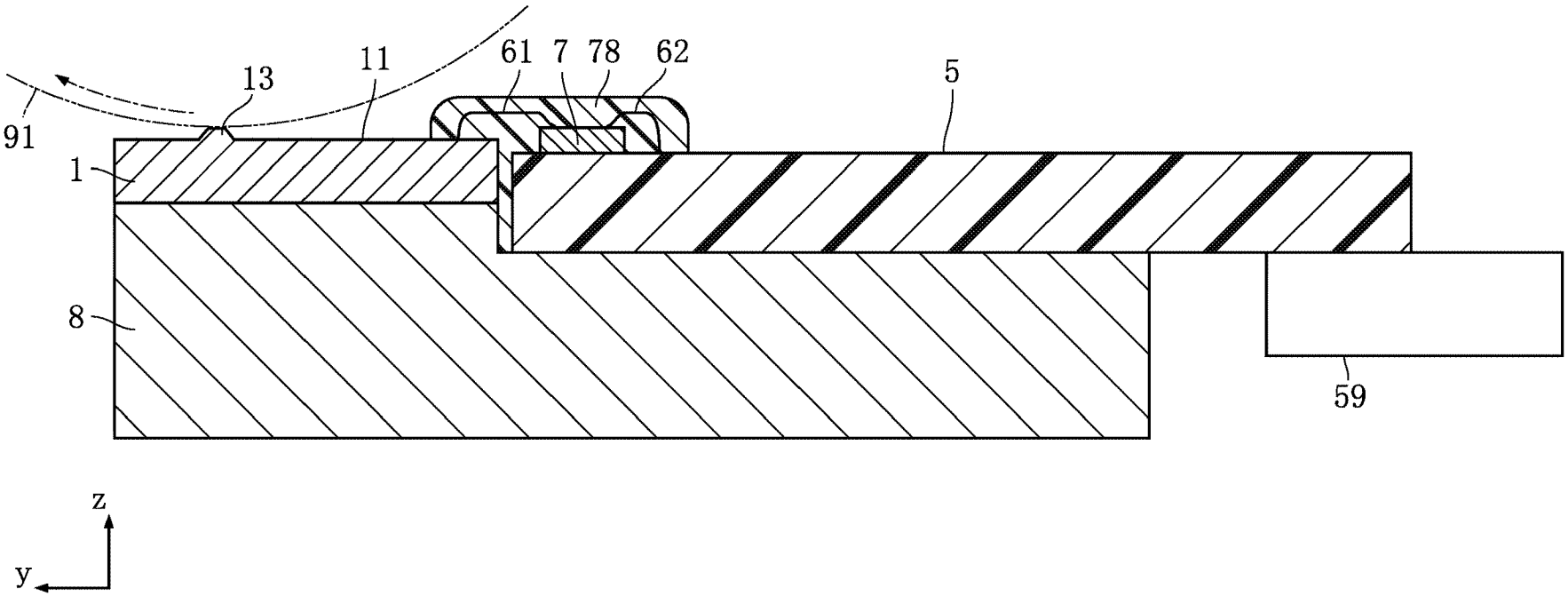
FIG. 4 is a cross-sectional view along the line IV-IV in FIG. 1.

Embodiments of the present disclosure are described below with reference to the accompanying drawings.

FIGS. 1 to 6 disclose a thermal print head according to a first embodiment of the present disclosure. A thermal print head A1 includes a head substrate 1, a connection substrate 5, and a heat dissipater 8. The head substrate 1 and the connection substrate 5 are mounted side-by-side on the heat dissipating member 8 in a sub-scanning direction y. The head substrate 1 is formed with a plurality of heat generating parts 41 aligned in a main scanning direction x according to the configuration described in detail below. The heat generating parts 41 are selectively driven to generate heat by driver ICs 7 mounted on the connection substrate 5, and perform printing on a printing medium, such as a thermal sheet, that is pressed by a platen roller 91 against the heat generating parts 41 according to a printing signal transmitted from an external source via a connector 59.

The head substrate 1 has a rectangular shape in plan view, with longer sides in the main scanning direction x and shorter sides in the sub-scanning direction y. The dimensions of the head substrate 1 may be, without limitation, 50 to 150 mm in the main scanning direction x, 2.0 to 5.0 mm in the sub-scanning direction y, and 725 μm in a thickness direction z. In the following description, the side of the head substrate 1 closer to the driver ICs 7 in the sub-scanning direction y is referred to as an upstream side, and the side of the head substrate 1 farther from the driver ICs 7 is referred to as a downstream side.

In the present embodiment, the head substrate 1 is made of a single-crystal semiconductor. The single-crystal semiconductor is preferably Si. The head substrate 1 has an obverse surface 11, and a protrusion 13 formed integrally with the obverse surface 11. Specifically, the protrusion 13 is formed in an area of the obverse surface 11 closer to the downstream side and extends in the main scanning direction x. The cross-sectional shape of the protrusion 13 is uniform in the main scanning direction x.

Figure 5:
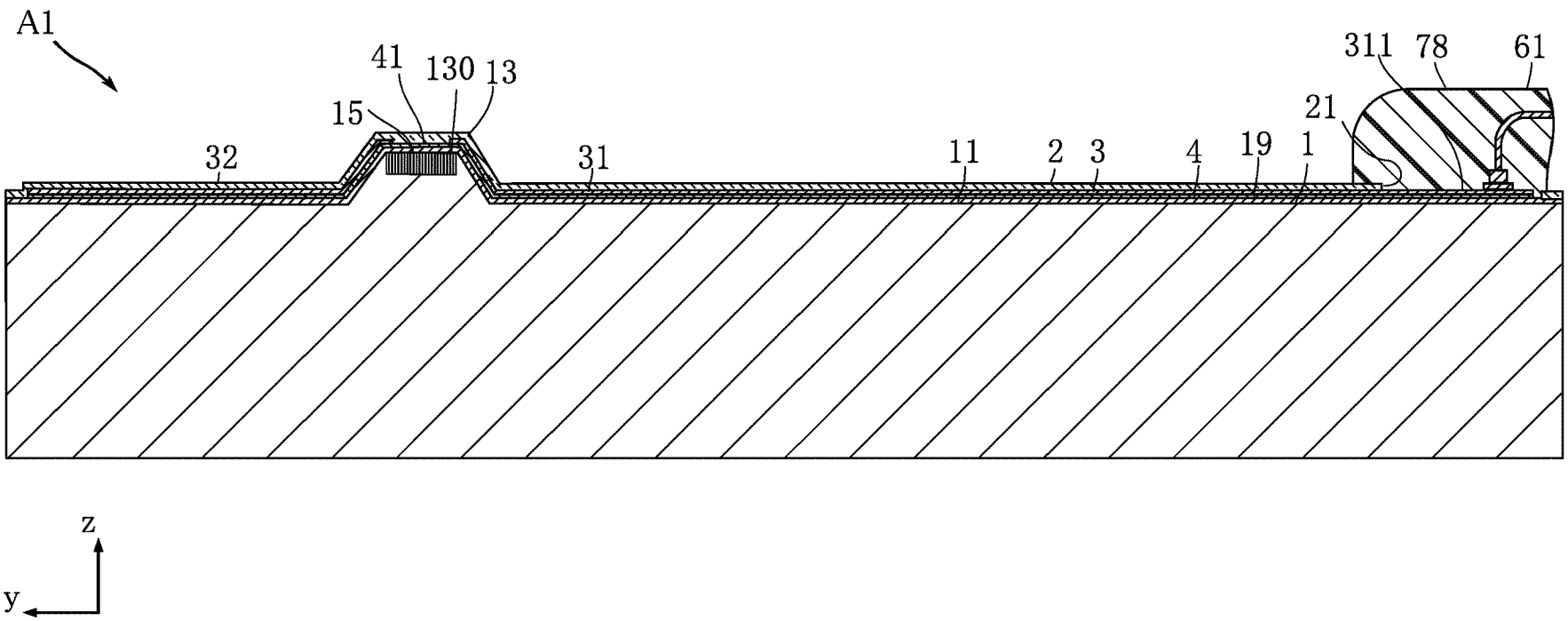
FIG. 5 is a main-part cross-sectional view showing the thermal print head according to the first embodiment.
Figure 6:
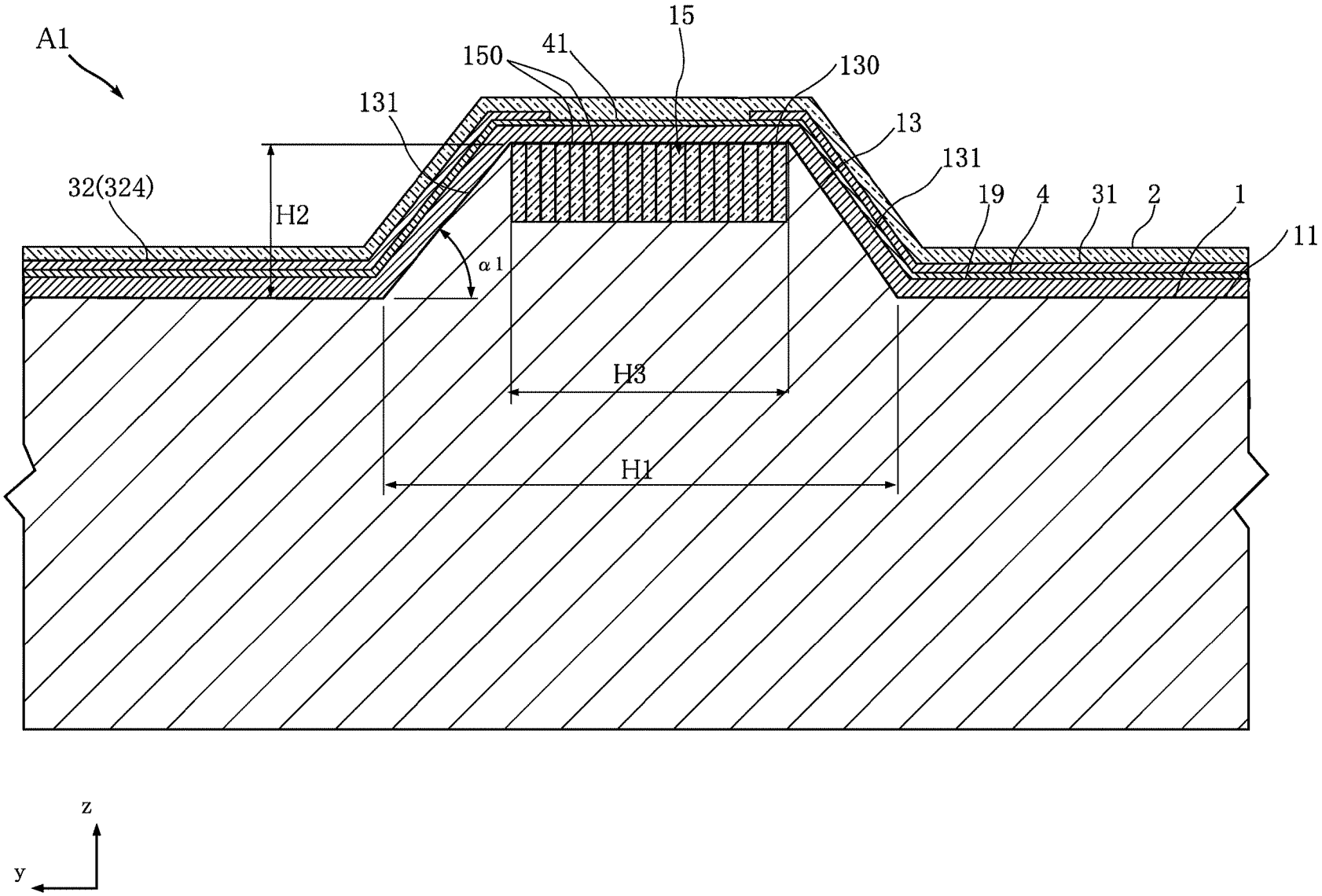
FIG. 6 is a main-part enlarged cross-sectional view showing the thermal print head according to the first embodiment.

As shown in FIGS. 5 and 6, the protrusion 13 has a top surface 130 that is parallel to the obverse surface 11, and a pair of first inclined outer surfaces 131 connected to and extending from both sides of the top surface 130 in the sub-scanning direction y and reaching the obverse surface 11. The pair of first inclined outer surfaces 131 are inclined to the obverse surface 11 to be lower with increasing distance from the top surface 130 in the sub-scanning direction y. An inclination angle α1 of each of the pair of first inclined outer surfaces 131 to the obverse surface 11 is 50 to 60 degrees. In the present embodiment, the protrusion 13 may have an entire width H1 of 200 to 300 μm in the sub-scanning direction y, and a height H2 of 150 to 180 μm. The top surface 130 may have a width H3 of 100 to 200 μm. Note that the obverse surface 11 of the head substrate 1 and the top surface of the protrusion 13 are (100) surfaces (in accordance with Miller index).

The top surface 130 of the protrusion 13 is formed with a heat storage 15 having a predetermined depth. The heat storage 15 is formed in a plan-view area extending in the main scanning direction x and having a predetermined width in the sub-scanning direction y, which is equal to the width of the top surface 130 in the sub-scanning direction y. The heat storage 15 is formed by densely embedding numerous micro-columnar heat storage members 150 that extend a predetermined length in the depth direction of the protrusion 13, with the upper ends of the micro-columnar heat storage members 150 positioned at the top surface 130 of the protrusion 13. According to the manufacturing method described below, the micro-columnar heat storage members 150 are formed by forming columnar micropores 150A by deep etching (DeepRIE) and performing a thermal oxidation treatment at approximately 800 to 1100° C. to change the composition of the inner surface of the columnar micropores 150A to $SiO_2$. The thermal oxidation treatment increases the volume of the part that has changed to $SiO_2$, and as a result, at least areas at and around the openings of the columnar micropores 150A are filled with $SiO_2$. It is preferable that the micro-columnar heat storage members 150 be arranged as densely as possible. In order to do so, the columnar micropores 150A having an inner diameter of 1 to 10 μm and a depth of 30 to 100 μm may be formed at 1- to 3-μm intervals in the main scanning direction x and in the sub-scanning direction y, and then a thermal oxidation treatment may be performed, as described in the manufacturing method described below.

At least an insulating layer 19, a resistor layer 4, an electrode layer 3, and a protective layer 2 are formed in the stated order to cover the obverse surface 11 of the head substrate 1 and the protrusion 13 in which the heat storage 15 is arranged in the above-described manner.

The insulating layer 19 covers the obverse surface 11 of the head substrate 1 and the protrusion 13. The insulating layer 19 is formed to cover an area in which the resistor layer 4 and the electrode layer 3 are to be formed (described below). The insulating layer 19 is made of an insulating material, such as $SiO_2$, SiN, or TEOS (tetraethyl orthosilicate). In the present embodiment, TEOS is suitably selected. The thickness of the insulating layer 19 is not particularly limited, and may be 5 μm to 15 μm, or preferably 5 μm to 10 μm.

The resistor layer 4 is formed across the obverse surface 11 and the protrusion 13 to cover the insulating layer 19. The insulating layer 19 is made of TaN, for example. The thickness of the resistor layer 4 is not particularly limited, and may be 0.02 μm to 0.1 μm, or preferably approximately 0.08 μm. The resistor layer 4 has exposed parts not covered with the electrode layer 3 (described below), and the exposed parts form the heat generating parts 41. The heat generating parts 41 are arranged at intervals in the main scanning direction x (see FIG. 3). In the sub-scanning direction y (see FIG. 5), each heat generating part 41 may extend over a part or the entirety of the top surface 130 of the protrusion 13. As readily understood, the heat generating parts 41 should be separated from each other on the main scanning direction x. Hence, the resistor layer 4 may have separations each extending in the sub-scanning direction y and passing through at least the elongated region (in the main scanning direction x) in which the heat generating parts 41 are to be formed.

The electrode layer 3 includes a plurality of individual electrode layers 31 formed on the upstream side of the head substrate 1, and a common electrode layer 32 on the downstream side of the head substrate 1. Each of the individual electrode layers 31 has a band shape that generally extends in the sub-scanning direction y, and the downstream end of each of the individual electrode layers 31 extends to an appropriate position of the protrusion 13 in the sub-scanning direction y. The upstream ends of the individual electrode layers 31 are formed with individual pads 311. The individual pads 311 are connected by wires 61 to the driver ICs 7 mounted on the connection substrate 5. The common electrode layer 32 has a plurality of comb teeth 324 and a common part 323 that connects the comb teeth 324 in common. The common part 323 is formed in the main scanning direction x along an edge of the head substrate 1 on the upstream side. Each of the comb teeth 324 has a band shape branching from the common part 323 and extending in the sub-scanning direction y. The upstream end of each of the comb teeth 324 extends to an appropriate position of the protrusion 13 in the sub-scanning direction y, and faces the downstream end of each of the individual electrode layers 31 with a predetermined space thereto. The common part 323 has an extended part 325. The extended part 325 bends in the sub-scanning direction y from both ends of the common part 323 in the main scanning direction x, and reaches the downstream side of the head substrate 1. The electrode layer 3 is made of Cu, for example, and may have a thickness of 0.3 to 2.0 μm. As described above, the ends of the individual electrode layers 31 face the ends of the comb teeth 324 of the common electrode layer 32 near the top surface of the protrusion 13, and the parts not covered with the individual electrode layers 31 or the comb teeth 324 form the heat generating parts 41.

The resistor layer 4 and the electrode layer 3 are further covered with the protective layer 2. The protective layer 2 is made of an insulating material, such as $SiO_2$, SiN, SiC, or AlN. The protective layer 2 has a thickness of 1.0 to 10 μm, for example.

As shown in FIG. 5, the protective layer 2 has pad openings 21. The pad openings 21 expose the individual pads 311 provided for the plurality of individual electrode layers 31.

The connection substrate 5 is disposed adjacent to the head substrate 1 on the upstream side in the sub-scanning direction y. The connection substrate 5 is a PCB substrate, for example, on which the driver ICs 7 and the connector 59 are mounted. The connection substrate 5 has a rectangular shape elongated in the main scanning direction x in plan view.

The driver ICs 7 are mounted on the connection substrate 5 to energize the heat generating parts 41 individually. The driver ICs 7 are connected to the individual pads 311 of the individual electrode layers 31 via the plurality of wires 61. The driver ICs 7 are also connected to a wiring pattern on the connection substrate 5 via wires 62. The driver ICs 7 receive a printing signal from an external source via the connector 59. The plurality of heat generating parts 41 are selectively heated by being energized individually according to the printing signal.

The driver ICs 7 and the wires 61, 62 are covered with a protective resin 78 that spans across the head substrate 1 and the connection substrate 5. The protective resin 78 may be a black insulating resin, such as a black epoxy resin.

The heat dissipating member 8 supports the head substrate 1 and the connection substrate 5, and is provided to dissipate a part of heat generated by the heat generating parts 41 to the outside. The heat dissipating member 8 is made of metal, such as aluminum.

The following describes an example of a method for manufacturing the thermal print head A1, with reference to FIGS. 7 to 16.

Figure 7:
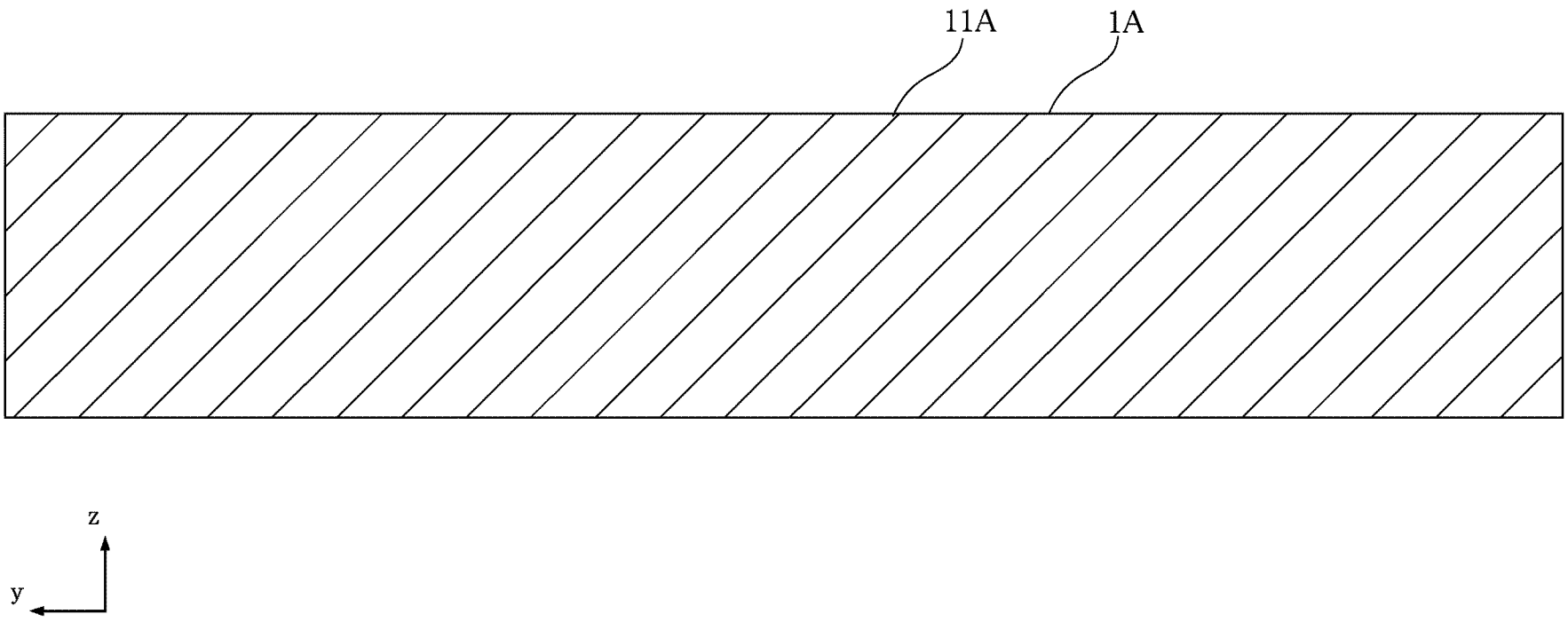
FIG. 7 is a main-part cross-sectional view showing an example of a method for manufacturing the thermal print head according to the first embodiment.

First, as shown in FIG. 7, a material substrate 1A is prepared. The material substrate 1A is made of a single-crystal semiconductor, such as a Si wafer. The material substrate 1A has a flat obverse surface 11A, which is a (100) surface.

Figure 8:
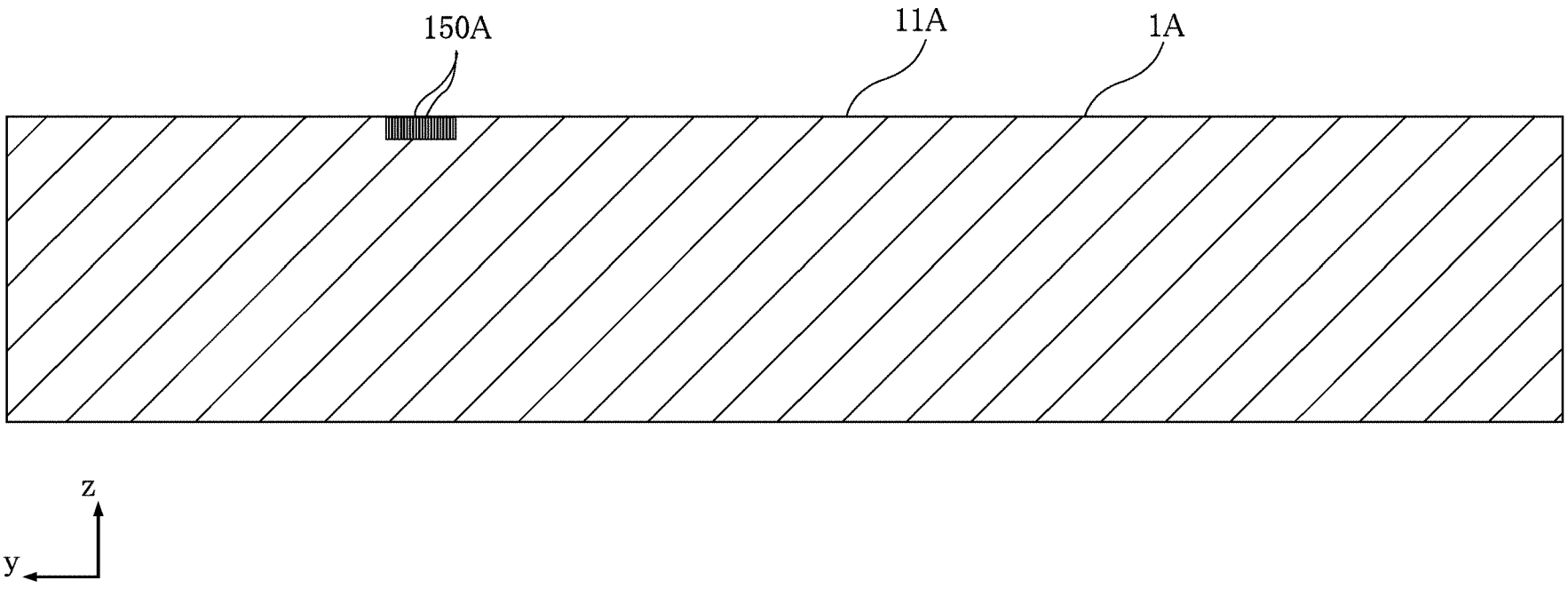
FIG. 8 is a main-part cross-sectional view showing an example of the method for manufacturing the thermal print head according to the first embodiment.
Figure 9:
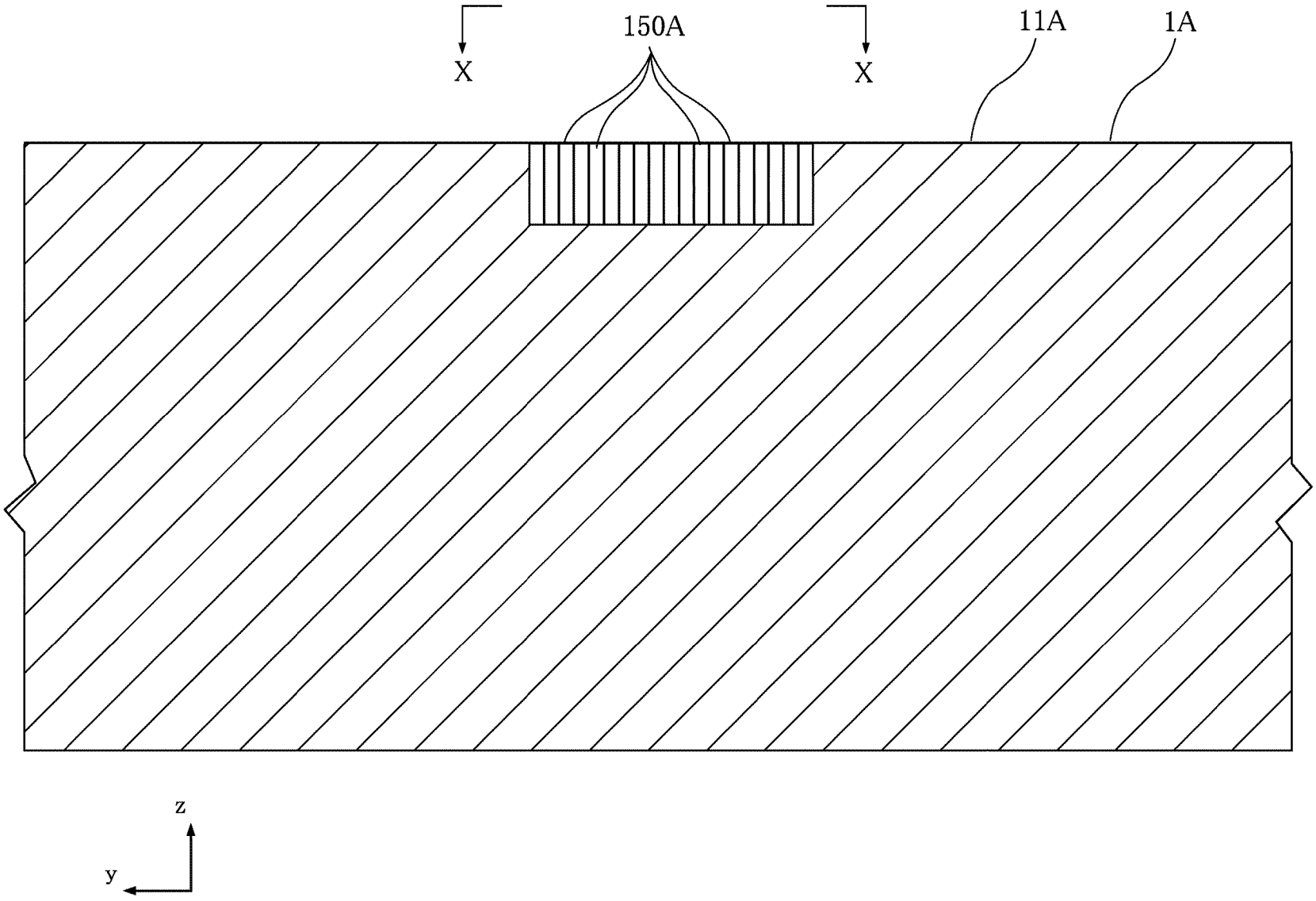
FIG. 9 is a main-part cross-sectional view showing an example of the method for manufacturing the thermal print head according to the first embodiment.
Figure 10:
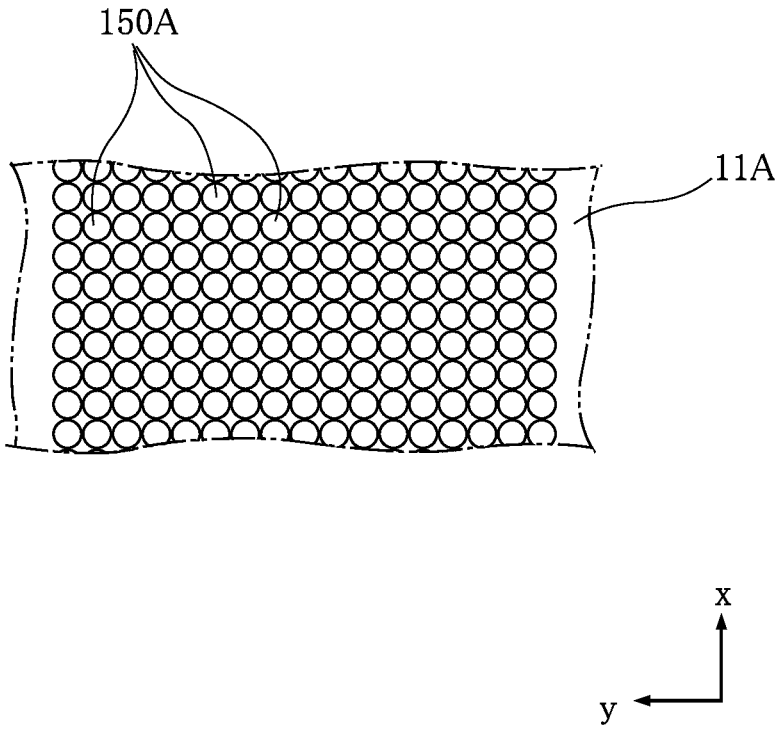
FIG. 10 shows a view seen in the direction of arrow X in FIG. 9.
Figure 11:
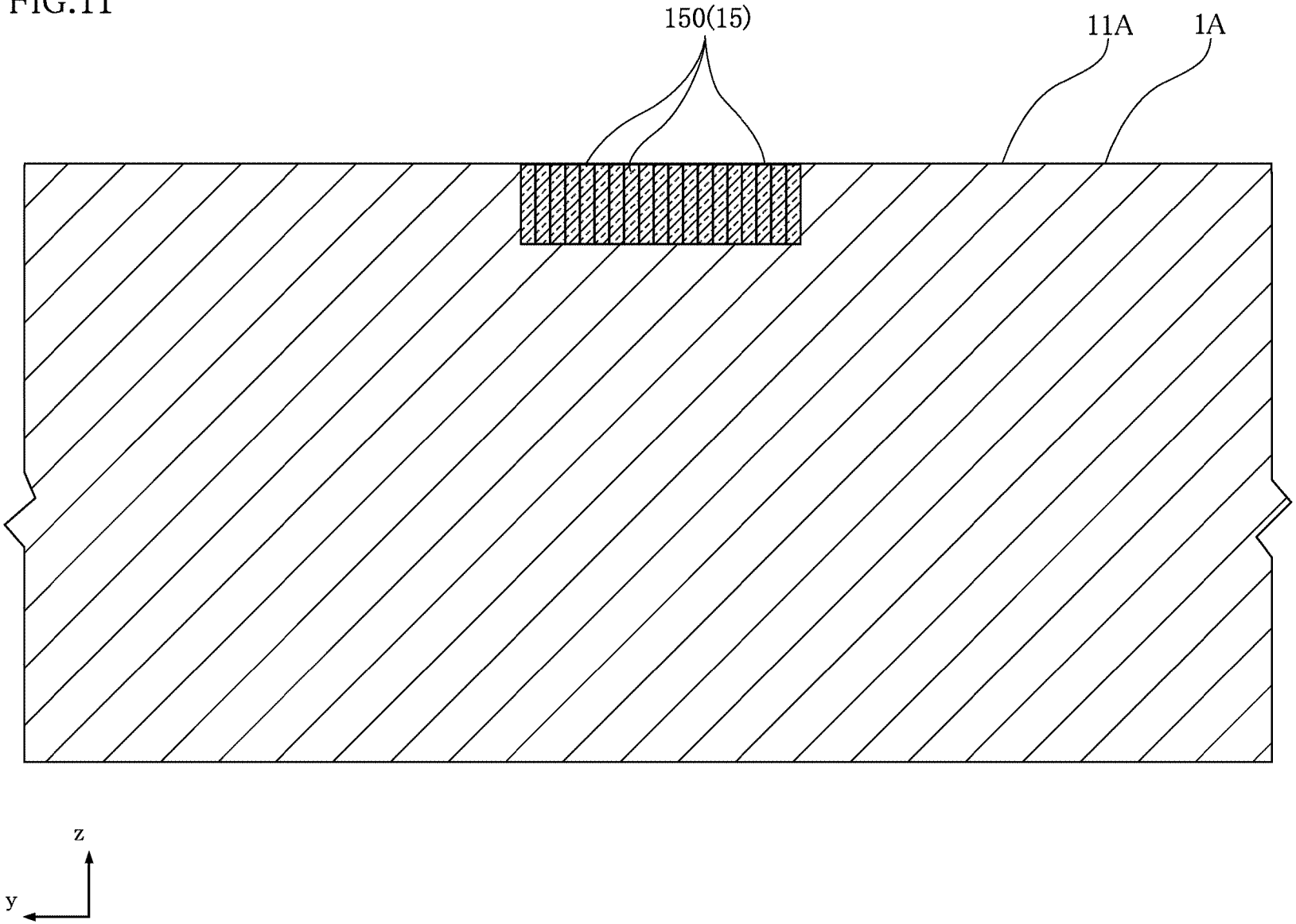
FIG. 11 is a main-part cross-sectional view showing an example of the method for manufacturing the thermal print head according to the first embodiment.

Next, as shown in FIGS. 8 to 10, the obverse surface 11A is deep etched, for example, to form the columnar micropores 150A each having an inner diameter of 1 to 10 μm and a depth of 30 to 100 μm at intervals of 1 to 3 μm in the main scanning direction x and the sub-scanning direction y. A flat area in which numerous columnar micropores 150A are formed in the above-described manner is where the top surface 130 of the protrusion 13 is to be formed as described below. For example, the area has a length of 100 to 200 μm in the sub-scanning direction y and extends in the main scanning direction x.

Next, as shown in FIG. 10, the numerous columnar micropores 150A are subjected to a thermal oxidation treatment at approximately 800 to 1100° C. As a result, the composition of the inner surfaces of the columnar micropores 150A is changed to $SiO_2$, and the heat storage 15 is formed that is made of the numerous micro-columnar heat storage members 150. During this period, Si changes to $SiO_2$ to cause an increase in volume. As such, at least the areas at and around the openings of the columnar micropores 150A are filled with $SiO_2$.

Figure 12:
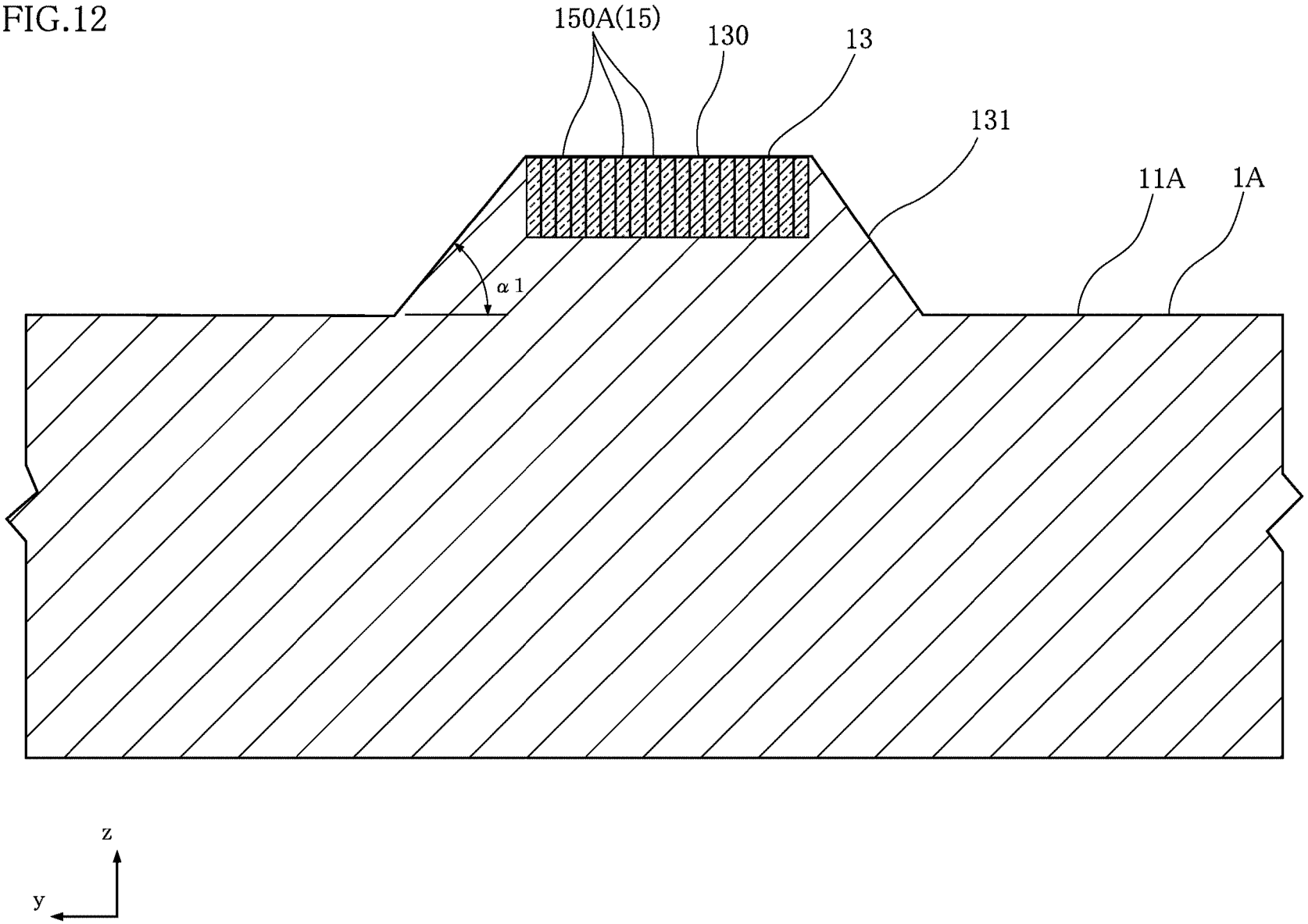
FIG. 12 is a main-part cross-sectional view showing an example of the method for manufacturing the thermal print head according to the first embodiment.

Next, an oxide film formed on the obverse surface 11A is removed by polishing as necessary, and anisotropic etching using e.g., KOH is performed to form the protrusion 13 having a substantially uniform cross section extending in the main scanning direction x, as shown in FIG. 12. At this point, the area in which the numerous micro-columnar heat storage members 150 are formed as described above can function as a mask. As described above, the protrusion 13 has the top surface 130 and the pair of inclined outer surfaces (first inclined outer surfaces) 131 sandwiching the top surface 130 in the sub-scanning direction y. The pair of inclined outer surfaces 131 connect to the respective edges of the top surface 130 in the sub-scanning direction y, and incline to be lower with increasing distance from the top surface 130 in the sub-scanning direction y.

Figure 13:
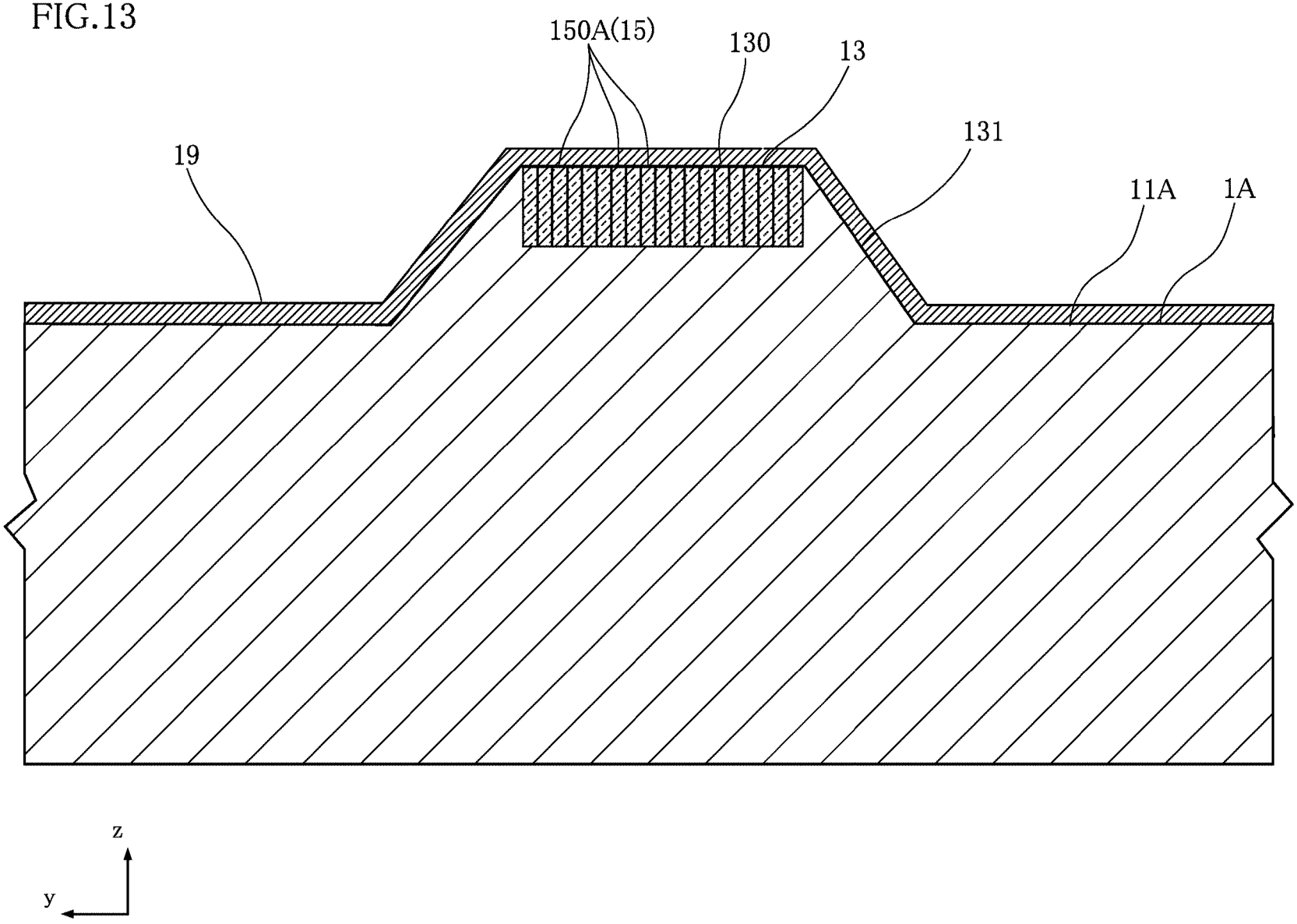
FIG. 13 is a main-part cross-sectional view showing an example of the method for manufacturing the thermal print head according to the first embodiment.

Next, the insulating layer 19 is formed, as shown in FIG. 13. The insulating layer 19 is formed by depositing TEOS using CVD, for example.

Figure 14:
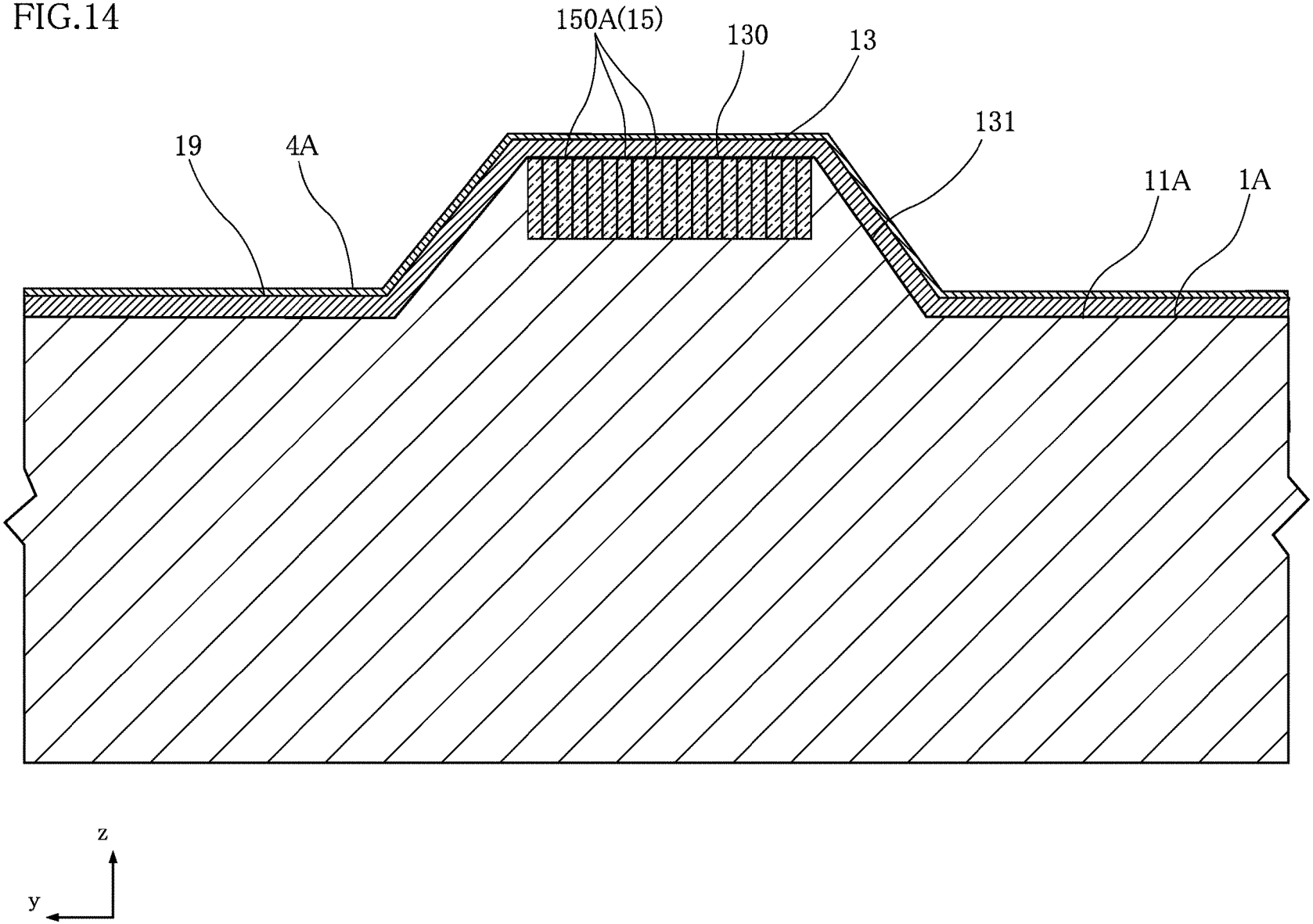
FIG. 14 is a main-part cross-sectional view showing an example of the method for manufacturing the thermal print head according to the first embodiment.

Next, a resistor film 4A is formed, as shown in FIG. 14. The resistor film 4A is formed by forming a thin TaN film on the insulating layer 19 through sputtering, for example.

Figure 15:
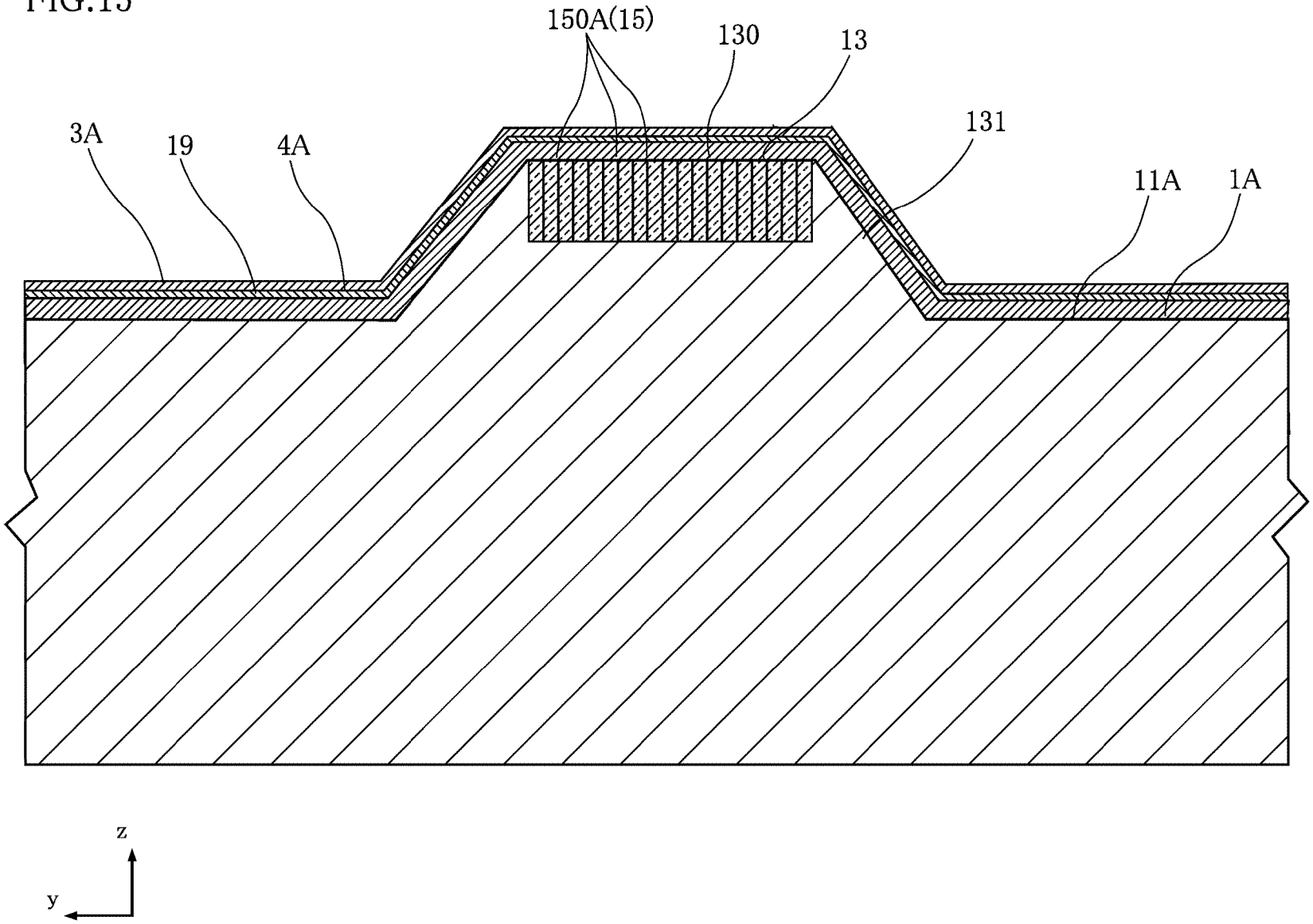
FIG. 15 is a main-part cross-sectional view showing an example of the method for manufacturing the thermal print head according to the first embodiment.

Next, a conductive film 3A is formed, as shown in FIG. 15. The conductive film 3A is formed by forming a Cu layer through plating or sputtering, for example.

Figure 16:
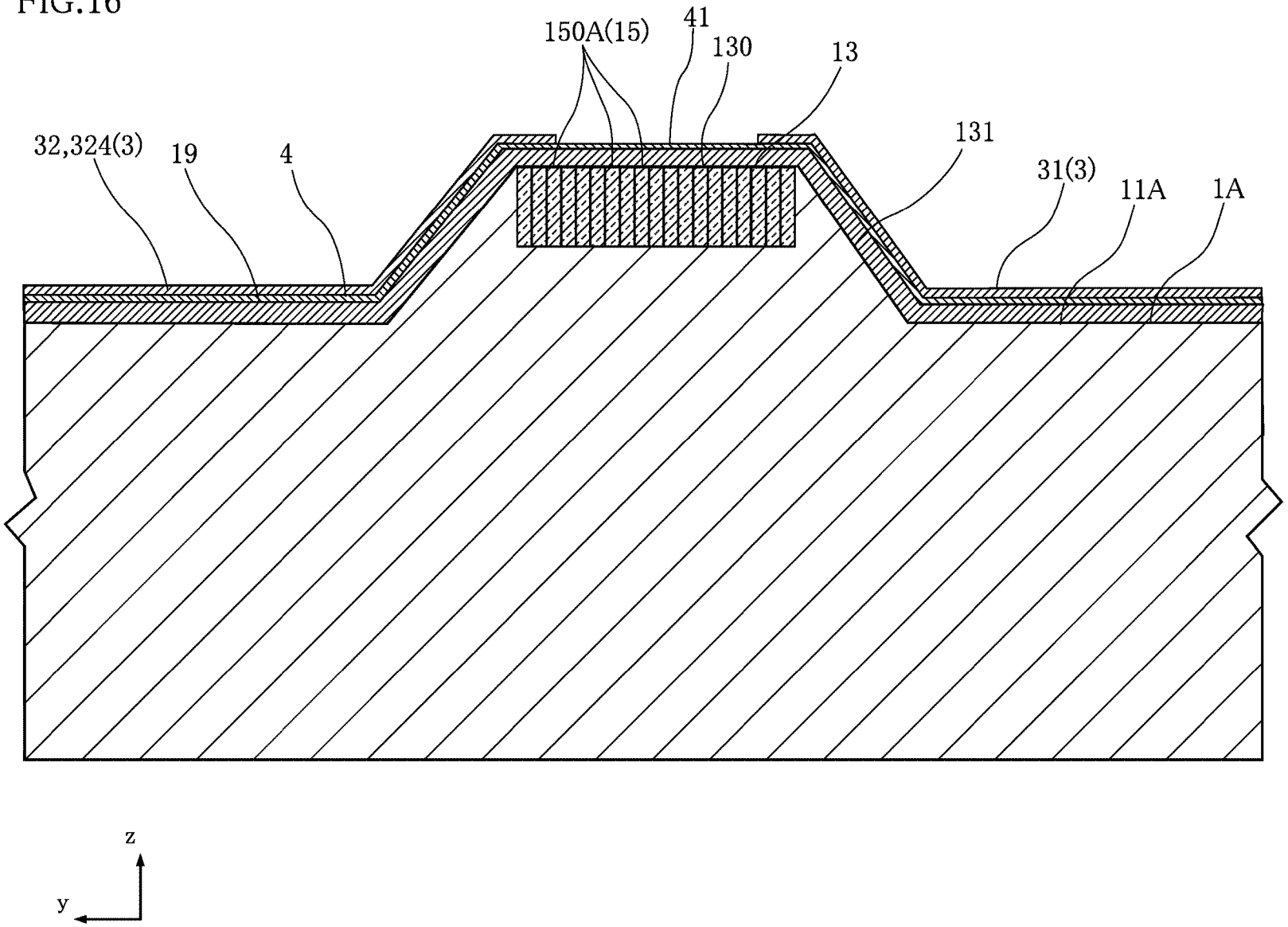
FIG. 16 is a main-part cross-sectional view showing an example of the method for manufacturing the thermal print head according to the first embodiment.

Subsequently, as shown in FIG. 16, the conductive film 3A and the resistor film 4A are selectively etched to form the resistor layer 4 separated into a plurality of areas in the main scanning direction x, as well as the individual electrode layers 31 and the comb teeth 324 of the common electrode layer 32 that cover the resistor layer 4 except the heat generating parts 41.

Next, the protective layer 2 is formed by depositing SiN and SiC on the insulating layer 19, the electrode layer 3, and the resistor layer 4 using CVD, for example. Next, the protective layer 2 is partially removed by etching, for example, to form the pad openings 21. Thereafter, operations such as assembling the head substrate 1 and the connection substrate 5 on the heat dissipating member 8, mounting the driver ICs 7 on the connection substrate 5, bonding of the wires 61 and 62, and forming the protective resin 78 are performed to manufacture the thermal print head A1 shown in FIGS. 1 to 6.

Next, advantages of the thermal print head A1 according to the first embodiment will be described.

Since the plurality of heat generating parts 41 are arranged near the top surface of the protrusion 13 of the head substrate 1, the printing medium is reliably pressed against the heat generating parts 41 by the platen roller 91. The protrusion 13 is formed by anisotropic etching to the single-crystal semiconductor, which allows the protrusion 13 to have a uniform cross section in the main scanning direction x. The printing medium is pressed into contact with the heat generating parts 41 uniformly and stably in any position in the main scanning direction x. These aspects do not change even if the manufacturing lot of the head substrate 1 is different. This leads to an improvement of the printing quality.

A Si wafer, which is the material of the head substrate 1, is not suitable for high-speed printing because it has better heat conductivity than an insulating material such as $SiO_2$, and causes the heat generated by the heat generating parts 41 to wastefully leak toward the heat dissipating member 8 if no measures are taken. In the thermal print head A1, however, the protrusion 13 is provided with the heat storage 15 that is made of $SiO_2$ and that has a predetermined depth directly below the heat generating parts 41, thereby preventing the wasteful leak of the heat generated by the heat generating parts 41 and making the Si wafer suitable for high-speed printing.

Figure 17:
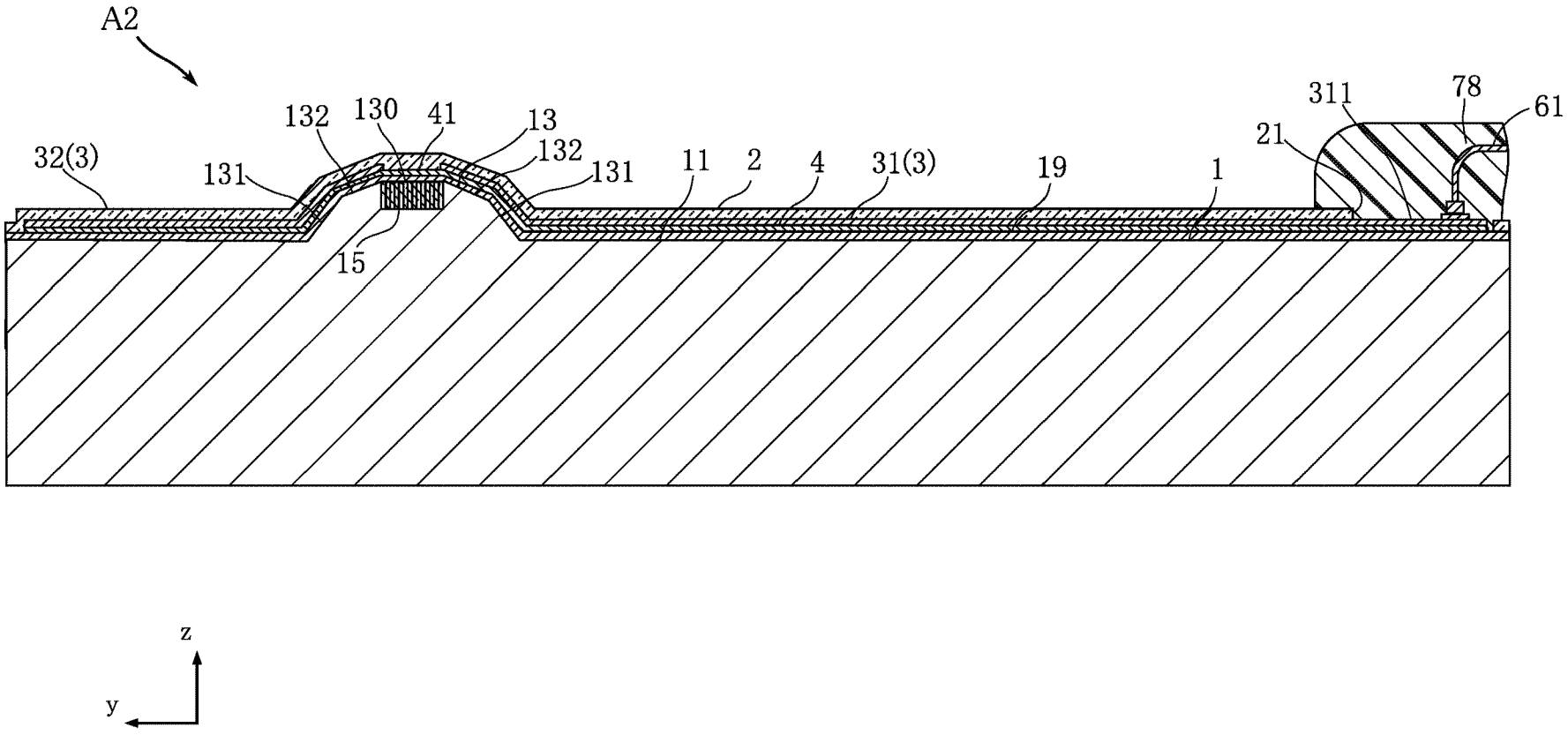
FIG. 17 is a main-part cross-sectional view showing a thermal print head according to a second embodiment of the present disclosure.
Figure 18:
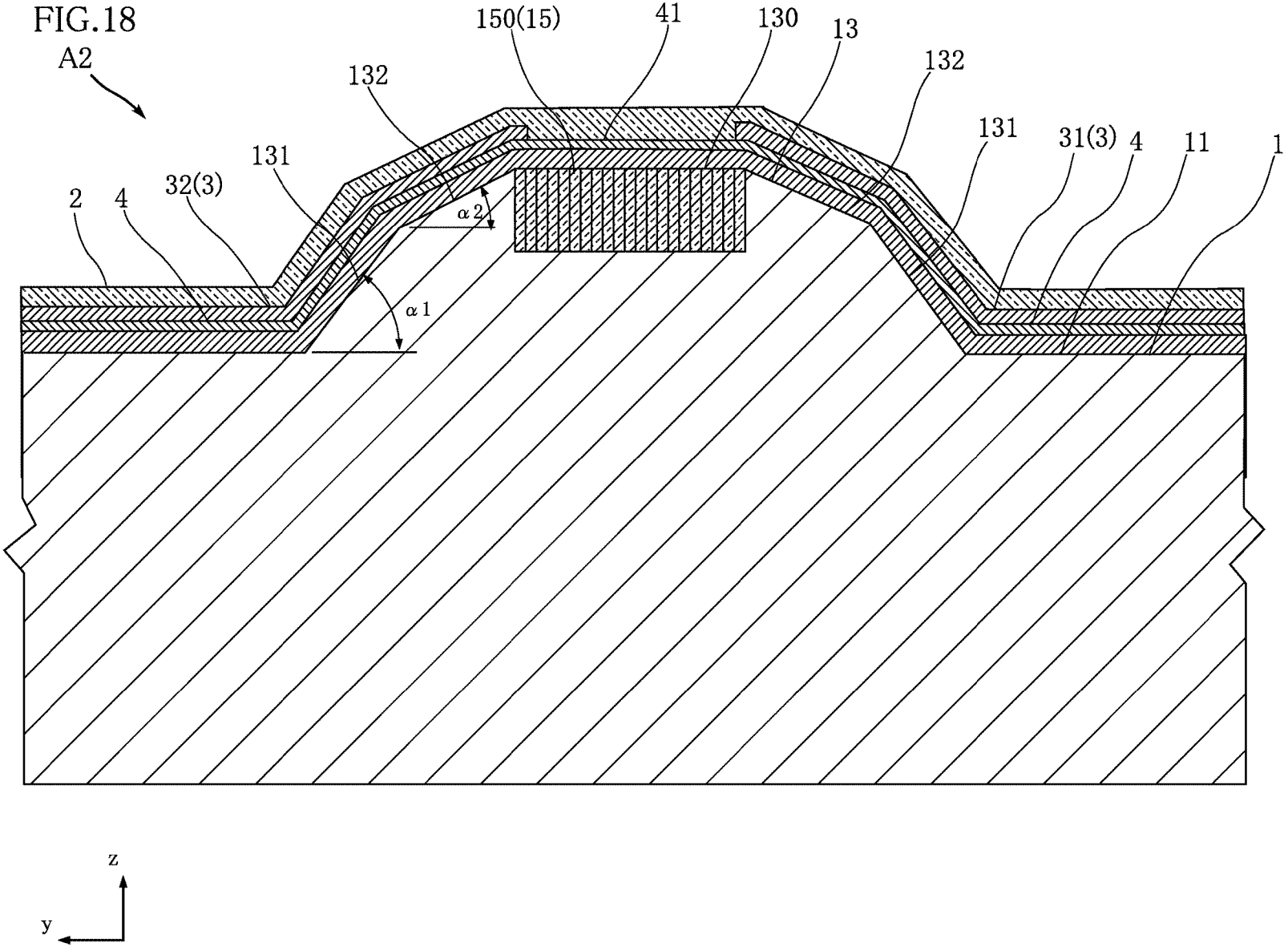
FIG. 18 is a main-part enlarged cross-sectional view showing the thermal print head according to the second embodiment.

FIGS. 17 and 18 show a thermal print head according to a second embodiment of the present disclosure. A thermal print head A2 is different from the thermal print head A1 according to the first embodiment with respect to the protrusion 13, but the rest of the configuration is the same as that of the thermal print head A1. In FIGS. 17 and 18, the parts or members that are the same as those of the thermal print head A1 are provided with the same reference signs, and the descriptions thereof will be omitted as appropriate.

In the present embodiment, the protrusion 13 provided on a head substrate 1 has a top surface 130, a pair of second inclined outer surfaces 132 connected to the respective edges of the top surface 130 in the sub-scanning direction y, and a pair of first inclined outer surfaces 131 connected to the outer edges of the pair of second inclined outer surfaces 132 in the sub-scanning direction y and reaching the obverse surface 11. The pair of first inclined outer surfaces 131 incline to be lower with increasing distance from the top surface in the sub-scanning direction y. The inclination angle $\alpha 1$ of each of the pair of first inclined outer surfaces 131 to the obverse surface 11 is 50 to 60 degrees, for example. The pair of second inclined outer surfaces 132 also incline to be lower with increasing distance from the top surface 130 in the sub-scanning direction y. The inclination angle α2 of each of the pair of second inclined outer surfaces 132 to the obverse surface 11 is 25 to 35 degrees, for example. The protrusion 13 of the present embodiment also has a substantially equal cross section in the main scanning direction x.

In the present embodiment, the top surface 130 of the protrusion 13 is formed with a heat storage 15 having a predetermined depth in the same manner as in the first embodiment, and the heat storage 15 is formed in a plan-view area extending in the main scanning direction x and having a predetermined width in the sub-scanning direction y, which is equal to the width of the top surface 130 in the sub-scanning direction y. In other words, the heat storage 15 is formed by densely embedding numerous micro-columnar heat storage members 150 that extend a predetermined length in the depth direction of the protrusion 13, with the upper ends of the micro-columnar heat storage members 150 positioned at the top surface 130 of the protrusion 13. The micro-columnar heat storage members 150 are formed by forming columnar micropores 150A by deep etching and performing a thermal oxidation treatment at approximately 800 to 1100° C. to change the composition of the inner surface of the columnar micropores 150A to $SiO_2$.

Similarly to the first embodiment, an insulating layer 19, a resistor layer 4, an electrode layer 3, and a protective layer 2 are formed in the stated order to cover the obverse surface 11 of the head substrate 1 and the protrusion 13 in which the heat storage 15 is arranged.

The structure of a connection substrate 5 arranged adjacent to the head substrate 1 and the structure of a heat dissipating member 8 on which the head substrate 1 and the connection substrate 5 are the same as in the first embodiment.

Next, an example of a method for manufacturing the thermal print head A2 will be described with reference to FIGS. 19 to 28.

Figure 19:
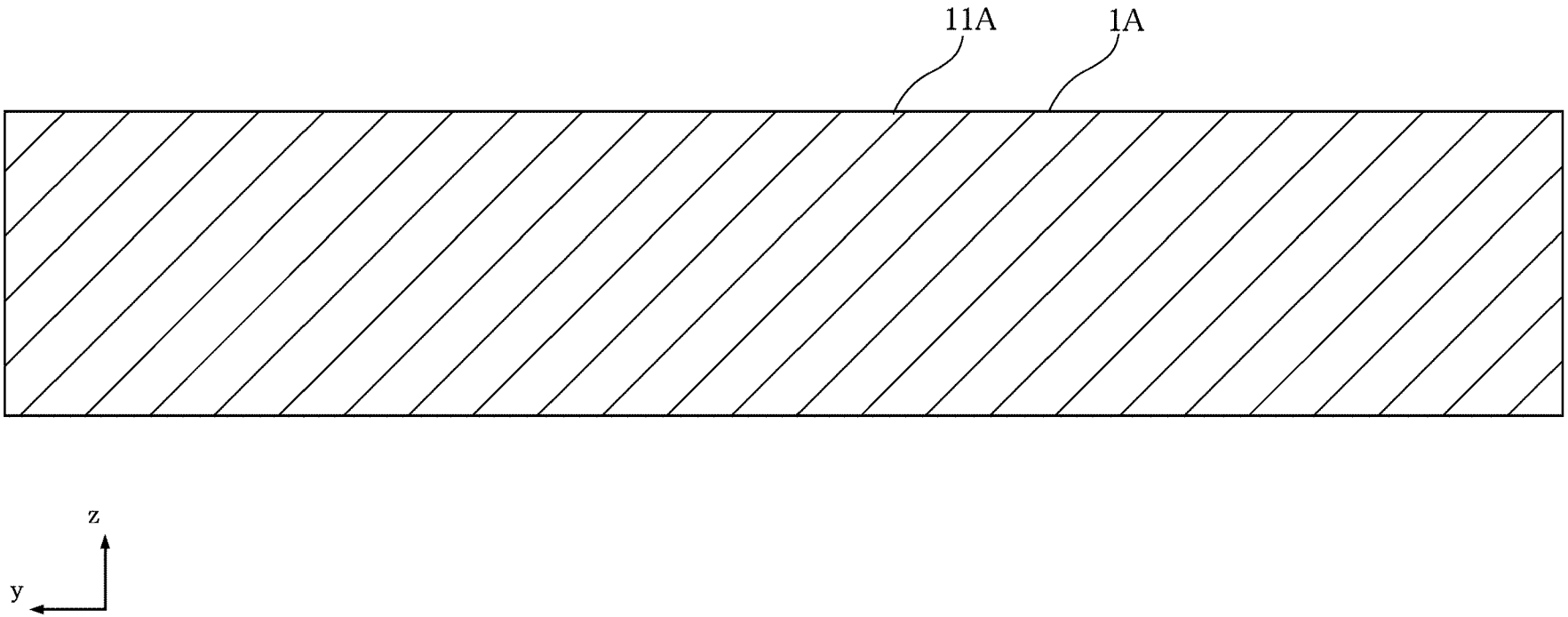
FIG. 19 is a main-part cross-sectional view showing an example of a method for manufacturing the thermal print head according to the second embodiment.

First, as shown in FIG. 19, a material substrate 1A is prepared. The material substrate 1A is made of a single-crystal semiconductor, such as a Si wafer. The material substrate 1A has a flat obverse surface 11A, which is a (100) surface.

Figure 20:
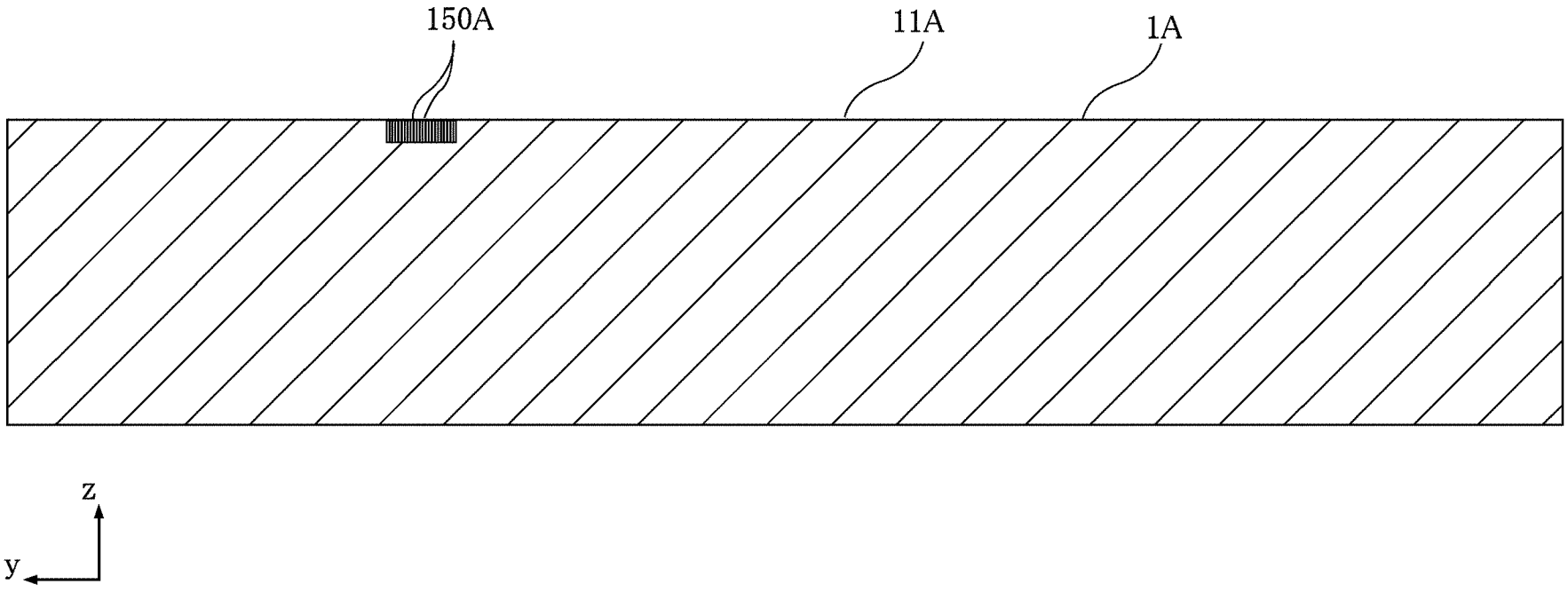
FIG. 20 is a main-part cross-sectional view showing an example of the method for manufacturing the thermal print head according to the second embodiment.
Figure 21:
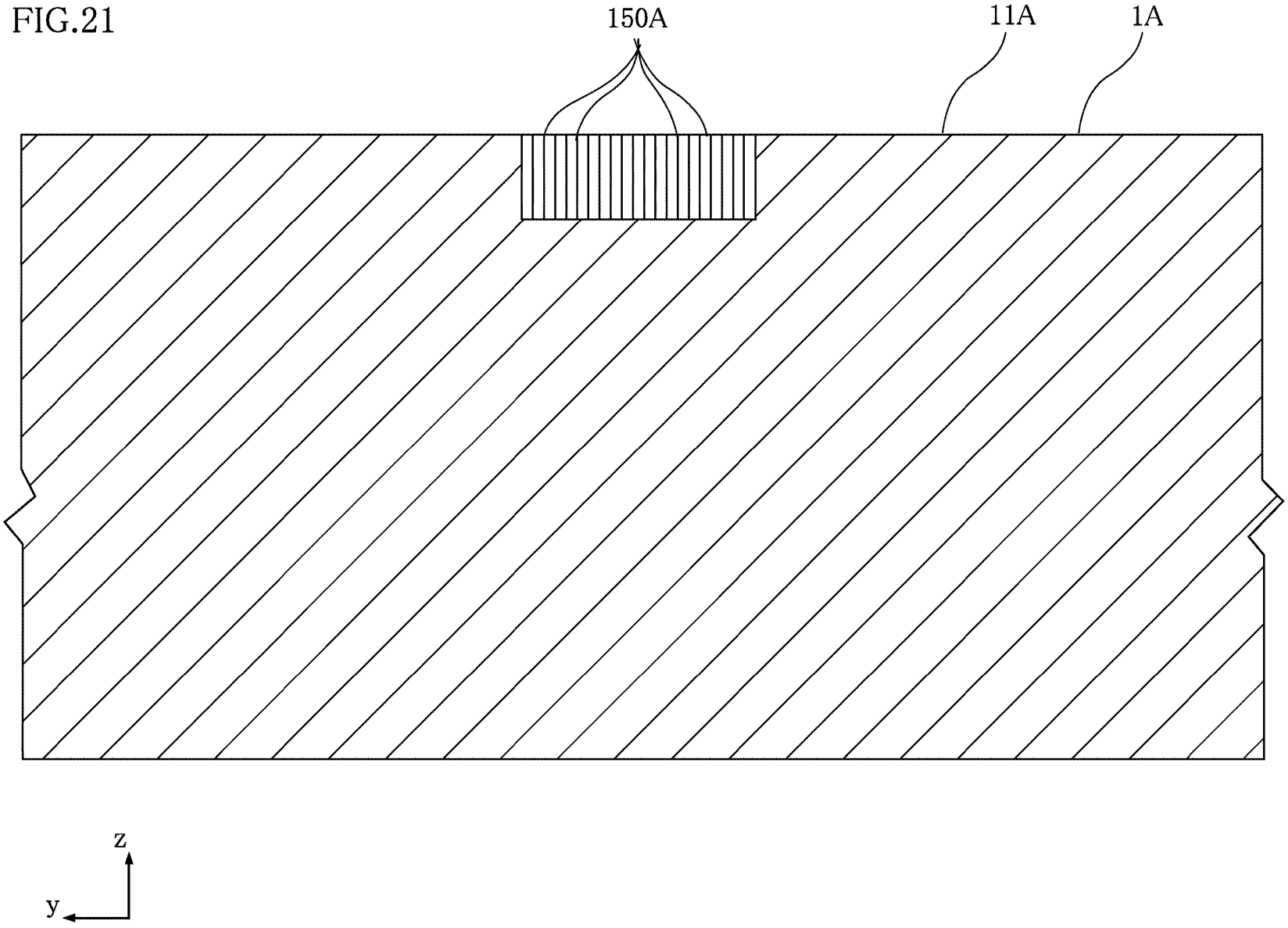
FIG. 21 is a main-part cross-sectional view showing an example of the method for manufacturing the thermal print head according to the second embodiment.

Next, as shown in FIGS. 20 and 21, the obverse surface 11A is deep etched, for example, to form the columnar micropores 150A each having an inner diameter of 1 to 10 μm and a depth of 30 to 100 μm at intervals of 1 to 3 μm in the main scanning direction x and the sub-scanning direction y. A flat area in which numerous columnar micropores 150A are formed in the above-described manner is where the top surface 130 of the protrusion 13 is to be formed as described below. For example, the area has a length of 100 to 200 μm in the sub-scanning direction y and extends in the main scanning direction x.

Figure 22:
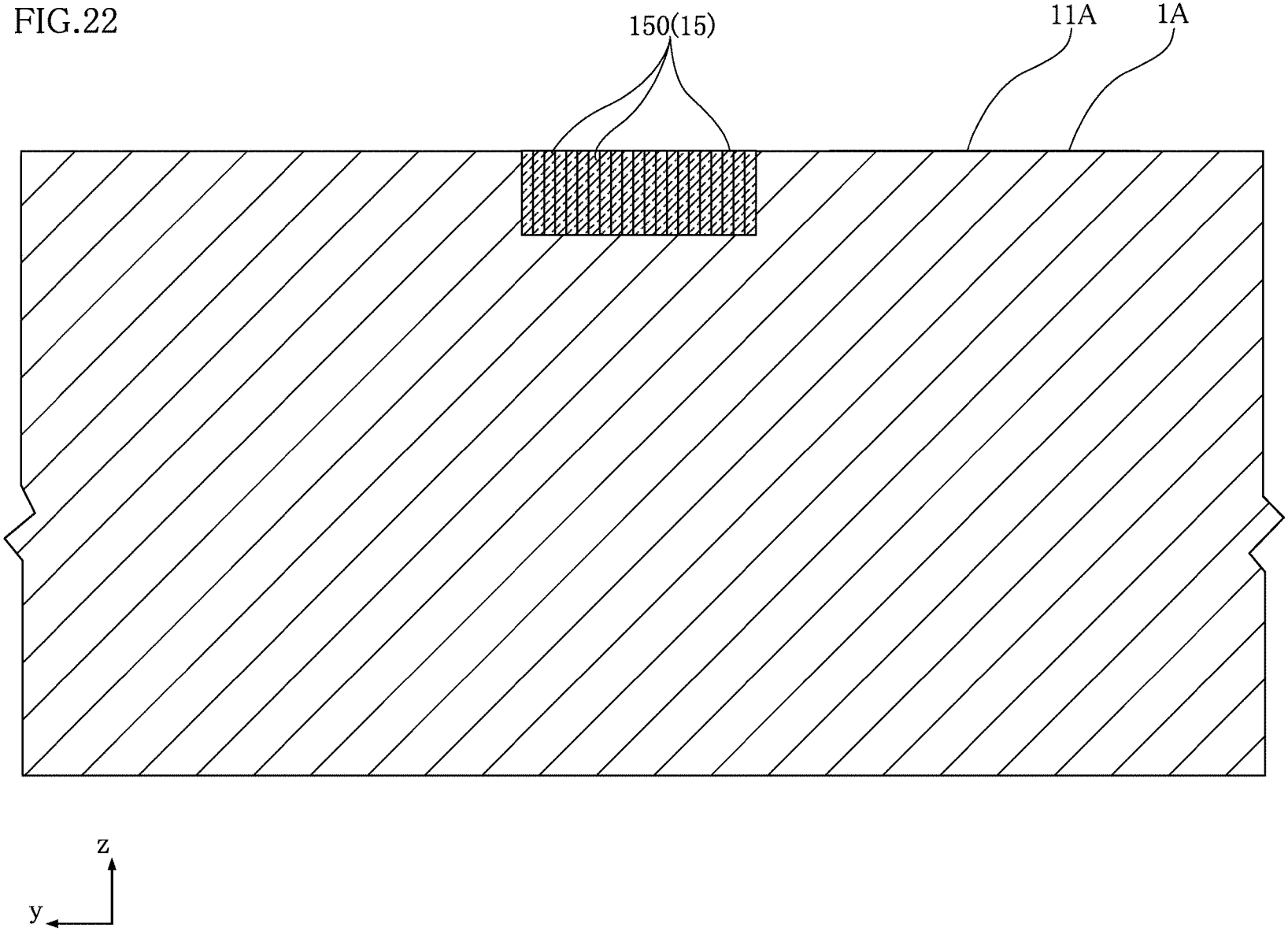
FIG. 22 is a main-part cross-sectional view showing an example of the method for manufacturing the thermal print head according to the second embodiment.

Next, as shown in FIG. 22, the numerous columnar micropores 150A are subjected to a thermal oxidation treatment at approximately 800 to 1100° C. As a result, the composition of the inner surfaces of the columnar micropores 150A is changed to $SiO_2$, and the heat storage 15 is formed that is made of the numerous micro-columnar heat storage members 150. During this period, Si changes to $SiO_2$ to cause an increase in volume. As such, at least the areas at and around the openings of the columnar micropores 150A are filled with $SiO_2$.

Figure 23:
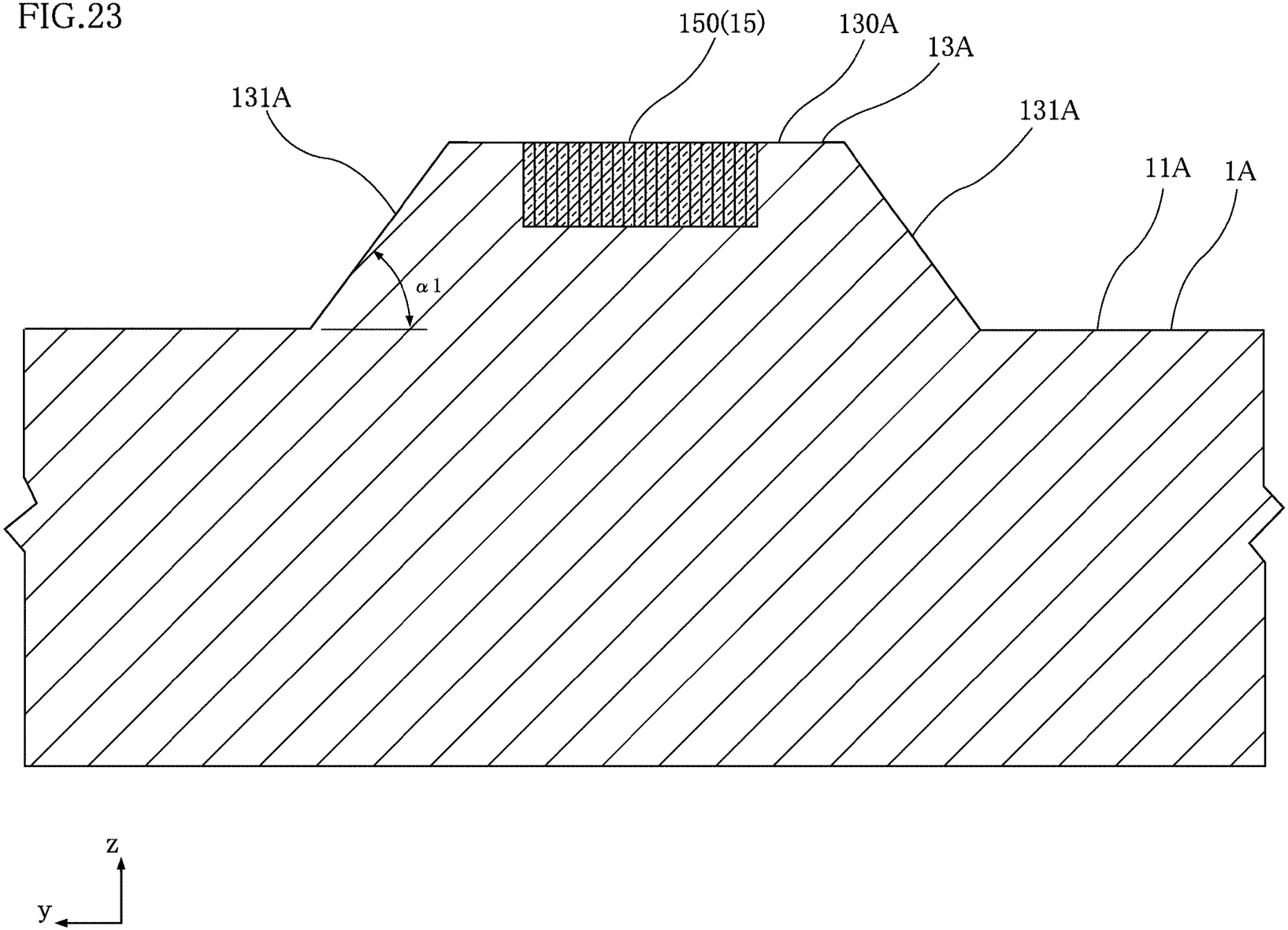
FIG. 23 is a main-part cross-sectional view showing an example of the method for manufacturing the thermal print head according to the second embodiment.

Next, an oxide film formed on the obverse surface 11A is removed by polishing as necessary. Thereafter, with the obverse surface 11A covered with a predetermined mask layer, anisotropic etching using e.g., KOH is performed to form a protrusion intermediate body 13A having a substantially uniform cross section extending in the main scanning direction x, as shown in FIG. 23. The protrusion intermediate body 13A has a top surface 130A and a pair of inclined outer surfaces 131A that sandwich the top surface 130A in the sub-scanning direction y. Parts of the pair of inclined outer surfaces 131A near the obverse surface 11 form the pair of first inclined outer surfaces 131. The top surface 130A is a flat (100) surface that is the remainder of the obverse surface 11A of the material substrate 1A. The pair of inclined outer surfaces 131A connect to the top surface 130A in the sub-scanning direction y, and incline to be lower with increasing distance from the top surface 130A in the sub-scanning direction y. In this state, the top or upper ends of the numerous micro-columnar heat storage members 150 formed as described above are exposed at the top surface 130A of the protrusion intermediate body 13A. The angle of each of the pair of first inclined outer surfaces 131A to the obverse surface 11 is 50 to 60 degrees.

Figure 24:
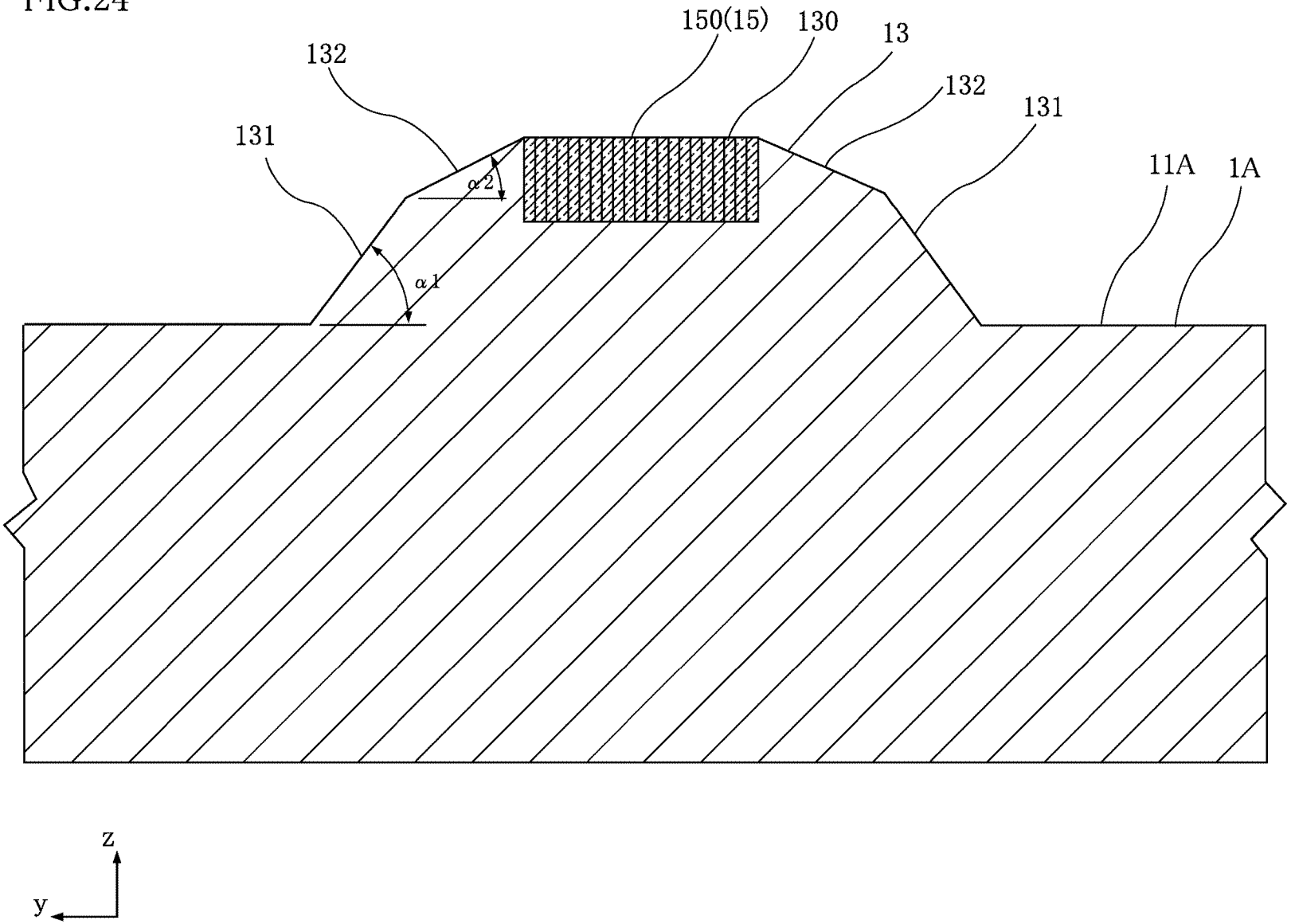
FIG. 24 is a main-part cross-sectional view showing an example of the method for manufacturing the thermal print head according to the second embodiment.

Next, the pair of second inclined outer surfaces 132 are formed on the protrusion intermediate body 13A by performing additional anisotropic etching using e.g., TMAH, as shown in FIG. 24 to complete the protrusion 13 having the pair of first inclined outer surfaces 131 and the pair of second inclined outer surfaces 132. The additional anisotropic etching can be performed with the numerous micro-columnar heat storage members 150, which are exposed at the top surface 130A of the protrusion intermediate body 13A, as a mask. The angle α2 of each of the pair of second inclined outer surfaces 132 to the obverse surface 11 is 25 to 35 degrees.

Figure 25:
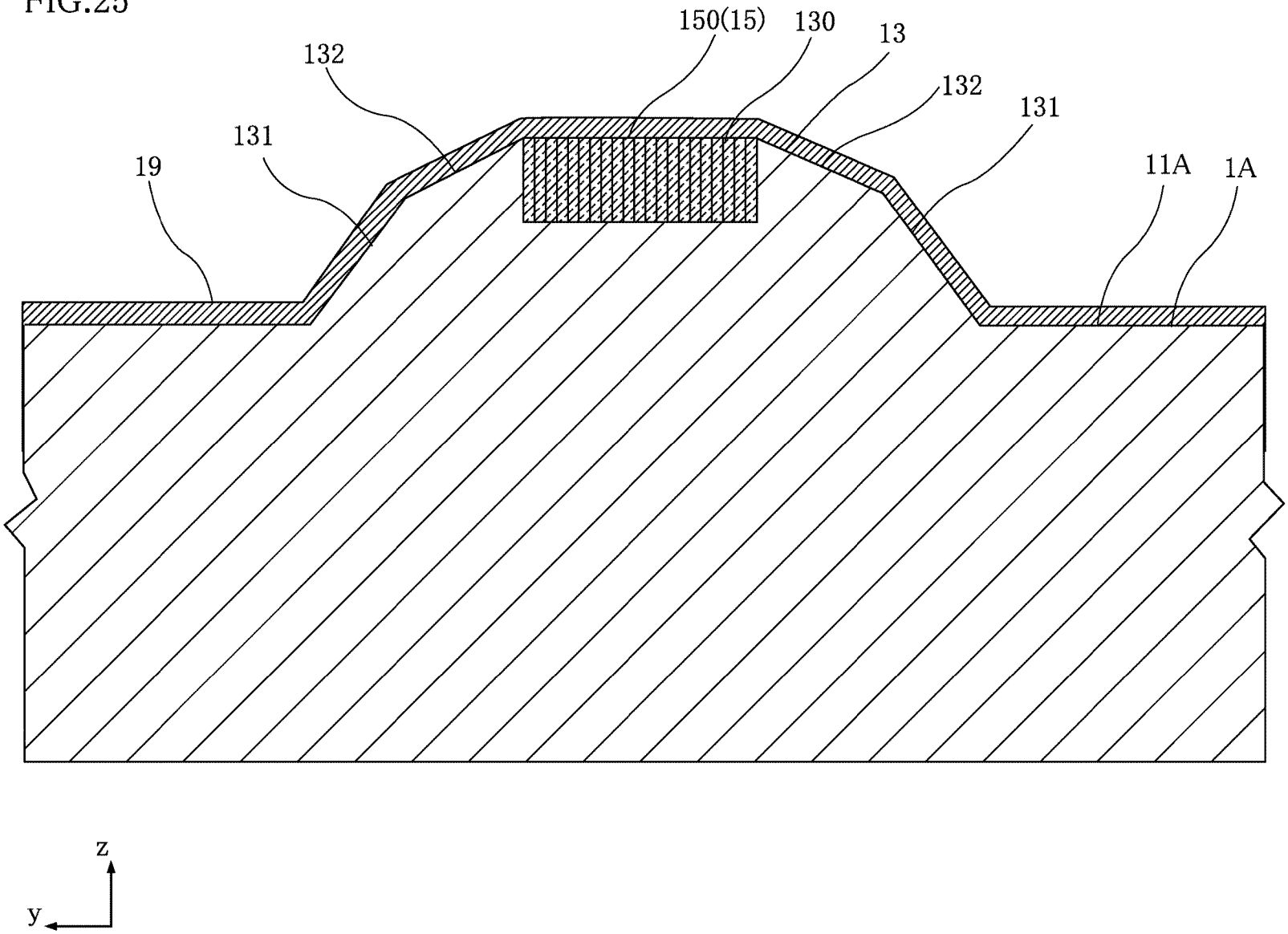
FIG. 25 is a main-part cross-sectional view showing an example of the method for manufacturing the thermal print head according to the second embodiment.

Next, the insulating layer 19 is formed, as shown in FIG. 25. The insulating layer 19 is formed by depositing TEOS using CVD, for example.

Figure 26:
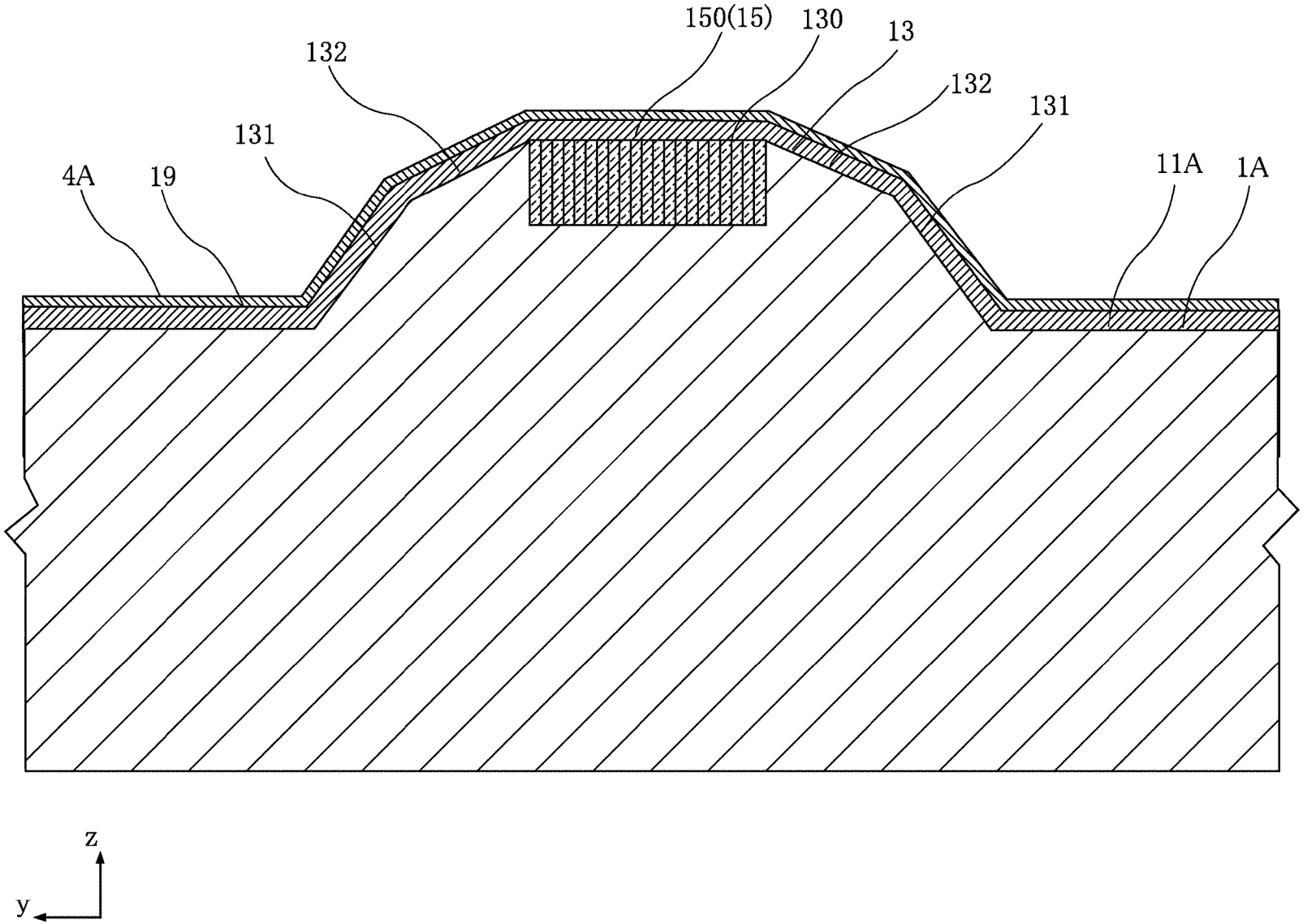
FIG. 26 is a main-part cross-sectional view showing an example of the method for manufacturing the thermal print head according to the second embodiment.

Next, a resistor film 4A is formed, as shown in FIG. 26. The resistor film 4A is formed by forming a thin TaN film on the insulating layer 19 through sputtering, for example.

Figure 27:
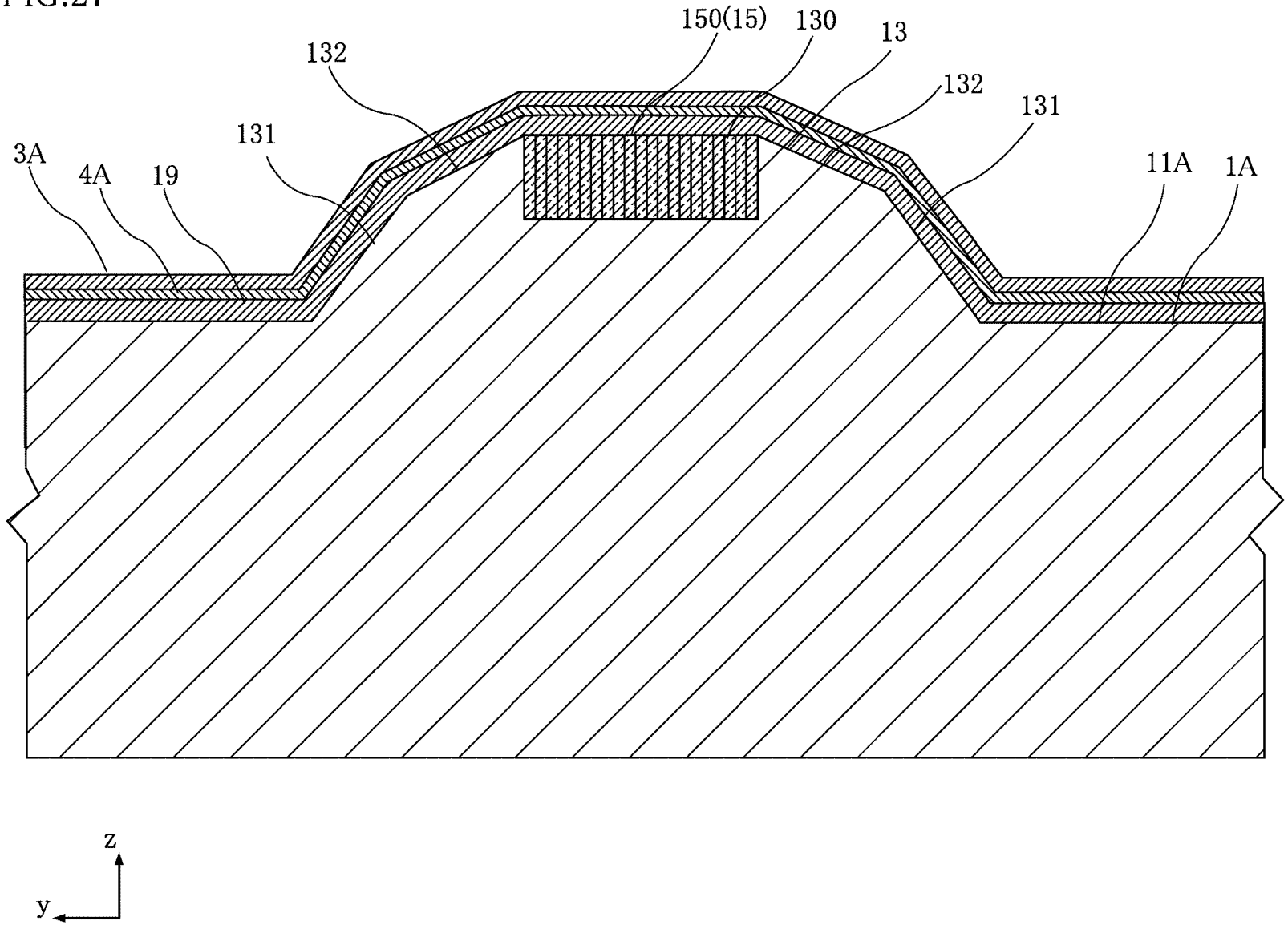
FIG. 27 is a main-part cross-sectional view showing an example of the method for manufacturing the thermal print head according to the second embodiment.
Figure 28:
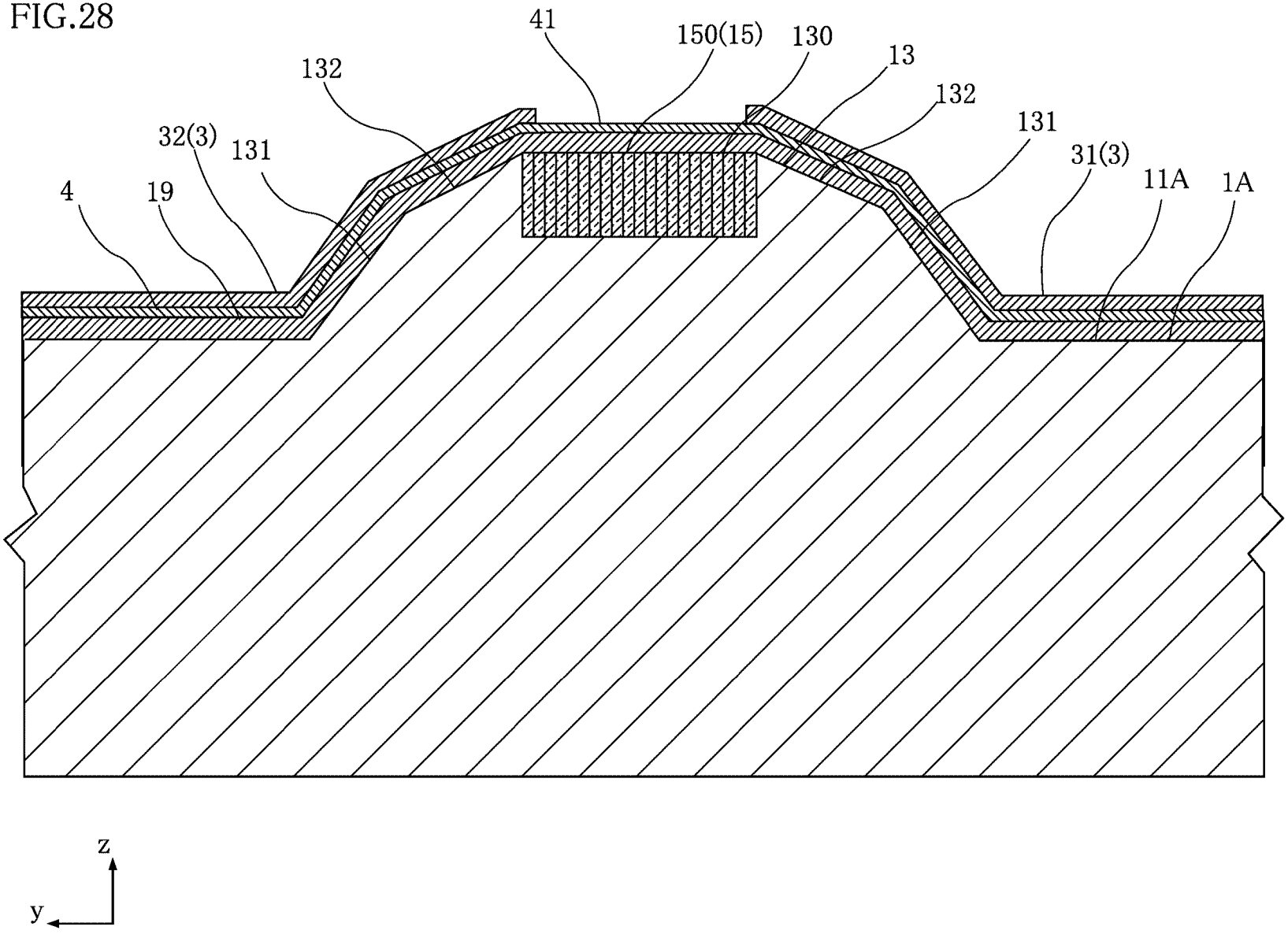
FIG. 28 is a main-part cross-sectional view showing an example of the method for manufacturing the thermal print head according to the second embodiment.

Next, a conductive film 3A is formed, as shown in FIG. 27. The conductive film 3A is formed by forming a Cu layer through plating or sputtering, for example.

Subsequently, the conductive film 3A and the resistor film 4A are selectively etched to form the resistor layer 4 separated into a plurality of areas in the main scanning direction x, as well as the individual electrode layers 31 and the comb teeth 324 of the common electrode layer 32 that cover the resistor layer 4 except the heat generating parts 41.

Next, the protective layer 2 is formed. The protective layer 2 is formed by depositing SiN and SiC on the insulating layer 19, the electrode layer 3, and the resistor layer 4 using CVD, for example. Next, the protective layer 2 is partially removed by etching, for example, to form the pad openings 21. Thereafter, operations such as assembling the head substrate 1 and the connection substrate 5 on the heat dissipating member 8, mounting the driver ICs 7 on the connection substrate 5, bonding of the wires 61 and 62, and forming the protective resin 78 are performed to manufacture the thermal print head A2 shown in FIGS. 17 and 18.

The thermal print head A2 also has the same advantages as the thermal print head A1 according to the first embodiment as described above.

In addition, the thermal print head A2 according to the present embodiment has two pairs of inclined outer surfaces, namely the first inclined outer surfaces 131 and the second inclined outer surfaces 132 that form the inclined outer surfaces of the protrusion 13. With this structure, a printing medium that is pressed against the protrusion 13 by the platen roller 91 can be smoothly transferred in the sub-scanning direction y without being caught.

The scope of the present disclosure is not limited to the embodiments described above, and any modifications made within the scope of the matters described in the claims shall be included in the scope of the present disclosure.

For example, in the thermal print head A2, the protrusion 13 may include third inclined outer surfaces (not shown) in addition to the first inclined outer surfaces 131 and the second inclined outer surfaces 132. The third inclined outer surfaces may be provided between the second inclined outer surfaces 132 and the top surface 130, and may have a smaller angle to the obverse surface 11 than the second inclined outer surfaces 132 do to the obverse surface 11, so that the surface of the protrusion 13 is smoother. Such a modification is also included in the scope of the present disclosure.

Furthermore, the plurality of heat generating parts 41 can take any form as long as they selectively energize the exposed parts of the resistor layer independently disposed in the main scanning direction x and cause the exposed parts to generate heat.

The invention claimed is:

1. A thermal print head comprising:

a substrate having an obverse surface;

a protrusion formed on the obverse surface of the substrate and extending in a main scanning direction;

heat generating parts disposed on a top surface of the protrusion and arranged along the main scanning direction; and columnar heat storage members embedded in the protrusion and disposed in a given area having a width in a sub-scanning direction and being elongated in the main scanning direction, wherein each of the columnar heat storage members is elongated in a thickness direction of the substrate and has an upper end and a lower end, the upper end being disposed at a same level of the top surface of the protrusion.

2. The thermal print head of claim 1, further comprising a resistor layer, an upstream conductive layer and a downstream conductive layer that are formed on the substrate, wherein the upstream conductive layer and the downstream conductive layer are capable of conducting electricity therebetween and formed on the resistor layer so as to expose a plurality of parts of the resistor layer corresponding to the heat generating parts.

3. The thermal print head of claim 1, wherein the protrusion is made of a single-crystal semiconductor.

4. The thermal print head of claim 3, wherein the protrusion and the substrate are formed integral with each other and made of a single-crystal semiconductor.

5. The thermal print head of claim 3, wherein the single-crystal semiconductor is made of Si, and each of the columnar heat storage members is made of $SiO_2$.

6. The thermal print head of claim 5, wherein each of the columnar heat storage members is configured to fill at least partially a corresponding micropore formed in the protrusion.

7. The thermal print head of claim 1, wherein the protrusion includes a pair of first inclined outer surfaces that are connected to respective sides of the top surface in the sub-scanning direction and inclined relative to the obverse surface so as to be lower with increasing distance from the top surface in the sub-scanning direction.

8. The thermal print head of claim 1, wherein the protrusion includes a pair of first inclined outer surfaces and a pair of second inclined outer surfaces, the pair of second inclined outer surfaces being connected to respective sides of the top surface in the sub-scanning direction and inclined relative to the obverse surface so as to be lower with increasing distance from the top surface in the sub-scanning direction, the pair of first inclined outer surfaces being connected to sides of the pair of second inclined outer surfaces opposite from sides thereof that are connected to the top surface in the sub-scanning direction, the pair of first inclined outer surfaces being inclined relative to the obverse surface with increasing distance from the top surface in the sub-scanning direction with an inclination angle relative to the obverse surface being greater than an inclination angle of the pair of second inclined outer surfaces relative to the obverse surface.

9. A method for manufacturing a thermal print head comprising: a substrate having an obverse surface; a protrusion formed on the obverse surface of the substrate and extending in a main scanning direction; heat generating parts disposed on a top surface of the protrusion and arranged along the main scanning direction; and columnar heat storage members embedded in the protrusion and disposed in a given area having a width in a sub-scanning direction and being elongated in the main scanning direction, each of the columnar heat storage members being elongated in a thickness direction of the substrate and having an upper end and a lower end, the upper end being disposed at a same level of the top surface of the protrusion, the top surface including a pair of first inclined outer surfaces that are connected to respective sides of the top surface in the sub-scanning direction and inclined relative to the obverse surface so as to be lower with increasing distance from the top surface in the sub-scanning direction, wherein the method comprises:

forming the columnar heat storage members in an area of an obverse surface of a material substrate made of a single-crystal semiconductor, the area corresponding to the top surface of the protrusion; and performing anisotropic etching with respect to the obverse surface of the material substrate so that the protrusion is formed to have the top surface and the pair of inclined outer surfaces.

10. The method according to claim 9, wherein the material substrate is a Si wafer, and the forming of the columnar heat storage members comprises:

performing deep etching with respect to the obverse surface of the material substrate so that micropores each extending in a thickness direction of the material substrate are formed in the material substrate; and performing a thermal oxidation treatment with respect to the micropores to produce $SiO_2$.

11. The method according to claim 10, wherein the obverse surface of the material substrate is a (100) surface, and the pair of first inclined outer surfaces are formed by performing anisotropic etching with respect to the (100) surface.

12. The method according to claim 11, wherein the anisotropic etching is performed with the area of the columnar heat storage members being used as a mask.

13. A method for manufacturing a thermal print head comprising: a substrate having an obverse surface; a protrusion formed on the obverse surface of the substrate and extending in a main scanning direction; heat generating parts disposed on a top surface of the protrusion and arranged along the main scanning direction; and columnar heat storage members embedded in the protrusion and disposed in a given area having a width in a sub-scanning direction and being elongated in the main scanning direction, each of the columnar heat storage members being elongated in a thickness direction of the substrate and has an upper end and a lower end, the upper end being disposed at a same level of the top surface of the protrusion, the protrusion including a pair of first inclined outer surfaces and a pair of second inclined outer surfaces, the pair of second inclined outer surfaces being connected to respective sides of the top surface in the sub-scanning direction and inclined relative to the obverse surface so as to be lower with increasing distance from the top surface in the sub-scanning direction, the pair of first inclined outer surfaces being connected to sides of the pair of second inclined outer surfaces opposite from sides thereof that are connected to the top surface in the sub-scanning direction, the pair of first inclined outer surfaces being inclined relative to the obverse surface with increasing distance from the top surface in the sub-scanning direction with an inclination angle relative to the obverse surface being greater than an inclination angle of the pair of second inclined outer surfaces relative to the obverse surface, wherein the method comprises:

forming the columnar heat storage members in an area of an obverse surface of a material substrate made of a single-crystal semiconductor, the area corresponding to the top surface of the protrusion; and performing anisotropic etching with respect to the obverse surface of the material substrate so that the protrusion is formed to have the pair of first inclined outer surfaces, the pair of second inclined outer surfaces and the top surface.

14. The method according to claim 13, wherein the material substrate is a Si wafer, and the forming of the columnar heat storage members comprises:

performing deep etching with respect to the obverse surface of the material substrate so that micropores each extending in a thickness direction of the material substrate are formed in the material substrate; and performing a thermal oxidation treatment with respect to the micropores to produce $SiO_2$.

15. The method according to claim 14, wherein the obverse surface of the material substrate is a (100) surface, the pair of first inclined outer surfaces are formed by performing anisotropic etching with respect to the (100) surface, and the pair of second inclined outer surfaces are formed by performing additional anisotropic etching.

16. The method according to claim 15, wherein the additional anisotropic etching is performed with the area of the numerous columnar heat storage members being used as a mask.

* * * * *